US011282529B2

(12) United States Patent
Sukowski et al.

(10) Patent No.: US 11,282,529 B2
(45) **Date of Patent: *Mar. 22, 2022**

(54) METHOD AND APPARATUS FOR OBTAINING SPECTRUM COEFFICIENTS FOR A REPLACEMENT FRAME OF AN AUDIO SIGNAL, AUDIO DECODER, AUDIO RECEIVER, AND SYSTEM FOR TRANSMITTING AUDIO SIGNALS

(71) Applicant: Fraunhofer-Gesellschaft zur Foerderung der angewandten Forschung e.V., Munich (DE)

(72) Inventors: Janine Sukowski, Erlangen (DE); Ralph Sperschneider, Ebermannstadt (DE); Goran Markovic, Nuremberg (DE); Wolfgang Jaegers, Erlangen (DE); Christian Helmrich, Erlangen (DE); Bernd Edler, Fuerth (DE); Ralf Geiger, Erlangen (DE)

(73) Assignee: Fraunhofer-Gesellschaft zur Förderung der angewandten Forschung e.V.

( * ) Notice: Subject to any disclaimer, the term of this patent is extended or adjusted under 35 U.S.C. 154(b) by 93 days.

This patent is subject to a terminal disclaimer.

(21) Appl. No.: 16/584,645

(22) Filed: Sep. 26, 2019

(65) Prior Publication Data

US 2020/0020343 A1 Jan. 16, 2020

Related U.S. Application Data

(63) Continuation of application No. 15/844,004, filed on Dec. 15, 2017, now Pat. No. 10,475,455, which is a (Continued)

(30) Foreign Application Priority Data

Jun. 21, 2013 (EP) ..... 13173161
May 5, 2014 (EP) ..... 14167072

(51) Int. Cl.
*G10L 19/005* (2013.01)
*G10L 19/06* (2013.01)
*G10L 19/02* (2013.01)

(52) U.S. Cl.
CPC ..... *G10L 19/005* (2013.01); *G10L 19/06* (2013.01); *G10L 19/0212* (2013.01)

(58) Field of Classification Search
CPC ... G10L 119/005; G10L 19/06; G10L 19/2012
See application file for complete search history.

(56) References Cited

U.S. PATENT DOCUMENTS 3,830,977 A 8/1974 Dechaux
6,138,101 A 10/2000 Fujii
(Continued)

FOREIGN PATENT DOCUMENTS

CN 1481546 A 3/2004
CN 1659625 A 8/2005
(Continued)

OTHER PUBLICATIONS

3GPP; "3rd Generation Partnership Project; Technical Specification Group Services and System Aspects; Speech codec speech processing functions; Adaptive Multi-Rate—Wideband (AMR-WB) speech codec; Error concealment of erroneous or lost frames (Release 12)," 3GPP TS 26.191, Sep. 2014; pp. 1-14.
(Continued)

*Primary Examiner* — Fariba Sirjani
(74) *Attorney, Agent, or Firm* — Haynes and Boone, LLP

(57) ABSTRACT

An approach is described that obtains spectrum coefficients for a replacement frame of an audio signal. A tonal component of a spectrum of an audio signal is detected based on a peak that exists in the spectra of frames preceding a replacement frame. For the tonal component of the spectrum a spectrum coefficients for the peak and its surrounding in the
(Continued)

spectrum of the replacement frame is predicted, and for the non-tonal component of the spectrum a non-predicted spectrum coefficient for the replacement frame or a corresponding spectrum coefficient of a frame preceding the replacement frame is used.

39 Claims, 8 Drawing Sheets

Related U.S. Application Data continuation of application No. 14/977,207, filed on Dec. 21, 2015, now Pat. No. 9,916,834, which is a continuation of application No. PCT/EP2014/063058, filed on Jun. 20, 2014.

(56) References Cited

U.S. PATENT DOCUMENTS

| | | | | |
|---|---|---|---|---|
| 6,351,730 | B2 | 2/2002 | Chen | |
| 6,418,408 | B1 | 7/2002 | Udaya Bhaskar et al. | |
| 6,496,797 | B1 | 12/2002 | Redkov et al. | |
| 7,050,972 | B2 * | 5/2006 | Henn | G10L 19/18 704/228 |
| 7,356,748 | B2 | 4/2008 | Taleb | |
| 9,916,834 | B2 * | 3/2018 | Sukowski | G10L 19/005 |
| 10,475,455 | B2 * | 11/2019 | Sukowski | G10L 19/06 |
| 2007/0094009 | A1 | 4/2007 | Ryu et al. | |
| 2007/0288232 | A1 | 12/2007 | Kim | |
| 2008/0046233 | A1 | 2/2008 | Chen et al. | |
| 2008/0126084 | A1 | 5/2008 | Lee et al. | |
| 2008/0133242 | A1 | 6/2008 | Sung et al. | |
| 2008/0167870 | A1 | 7/2008 | Hetherington et al. | |
| 2009/0006103 | A1 | 1/2009 | Koishida et al. | |
| 2010/0063802 | A1 | 3/2010 | Gao | |
| 2011/0035213 | A1 | 2/2011 | Malenovsky et al. | |
| 2011/0270616 | A1 | 11/2011 | Garudadri et al. | |
| 2012/0109659 | A1 | 5/2012 | Wu et al. | |
| 2012/0245947 | A1 | 9/2012 | Neuendorf et al. | |
| 2012/0290112 | A1 | 11/2012 | Kim | |
| 2013/0006644 | A1 * | 1/2013 | Jiang | G10L 21/038 704/500 |
| 2014/0074486 | A1 | 3/2014 | Disch et al. | |
| 2014/0108020 | A1 | 4/2014 | Sharma et al. | |
| 2015/0255074 | A1 | 9/2015 | Jeong et al. | |
| 2015/0371641 | A1 | 12/2015 | Bruhn | |
| 2015/0379998 | A1 | 12/2015 | Naslund et al. | |
| 2020/0020343 | A1 * | 1/2020 | Sukowski | G10L 19/005 |

FOREIGN PATENT DOCUMENTS

| | | | |
|---|---|---|---|
| CN | 102089806 | A | 6/2011 |
| CN | 102177543 | A | 9/2011 |
| CN | 1930607 | A | 3/2017 |
| EP | 0259950 | A1 | 3/1988 |
| EP | 0574288 | B1 | 1/1997 |
| EP | 1271471 | A2 | 1/2003 |
| JP | 2004-504637 | A | 2/2004 |
| JP | 2015527765 | A | 9/2015 |
| KR | 1020080070026 | A | 7/2008 |
| RU | 2419891 | C2 | 2/2010 |
| WO | WO 2002/059875 | A2 | 8/2002 |
| WO | WO 2007/051124 | A1 | 5/2007 |
| ZA | ZA 201203231 | A | 1/2013 |

OTHER PUBLICATIONS

Bartkowiak et al.; "Mitigatin of Long Gaps in Music using Hybrid Sinusoidal+Noise Model with Context Adaptation," The International Conference on Signals and Electronic Systems, Sep. 7-10, 2010; pp. 435-438; Gliwice, Poland.

Daudet et al.; "MDCT Analysis of Sinusoids: Exact Results and Applications to Coding Artifacts Reduction," IEEE Transactions on Speech and Audio Processing, May 200A; 12(3):302-312.

Ferreira, Anibal J.S.; Accurate Estimation in the ODFT Domain of the Frequency, Phase and Magnitude of Stationary Sinusoids, IEEE Workshop on Applications of Signal Processing to Audio Acoustics, Oct. 21-24, 2001; pp. 47-50; New Paltz, New York.

ISO/IEC; "Information technology—MPEG audio technologies—Part 2: Spatial Audio Object Coding (SAOC)," ISO/IEC 23003-2, Oct. 1, 2010; pp. i-130.

Lauber et al.; "Error Concealment for Compressed Digital Audio," 111th Convention of Audio Engineering Society, Sep. 21-24, 2001; pp. 1-11; New York, New York.

Mahieux et al.; "Transform Coding of Audio Signals Using Correlation Between Successive Transform Blocks," IEEE Acoustics, Speech, and Signal Processing, 1989; pp. 2021-22024.

Parikh et al.; "Frame Erasure Concealment Using Sinusoidal Analysis-Synthesis and Its Application to MDCT-Based Codecs," IEEE, 2000; pp. 905-908.

Paul, Douglas B.; "The Spectral Envelope Estimation Vocoder," IEEE Transactions on Acoustics, Speech, and Signal Processing, Aug. 1981; ASSP-29(A):786-794.

Ryu et al.; "Advances in Sinusoidal Analysis/Synthesis-based Error Concealment in Audio Networking," 116th Convention of Audio Engineering Society, May 8-11, 2004; pp. 1-11; Berlin, Germany.

Ryu et al.; "Encoder Assisted Frame Loss Concealment for MPEG-AAC Decoder," IEEE, 2006; pp. V-169-V-172.

Ryu et al.; "A Frame Loss Concealment Technique for MPEG-AAC," 120th Convention of Audio Engineering Society, May 20-23, 2006; pp. 1-13; Paris, France.

Ryu, Sang-Uk; "Source Modeling Approaches to Enhanced Decoding in Lossy Audio Compression and Communication," University of California Dissertation, Sep. 2006; pp. i-165; Santa Barbara, California.

Pierre Lauber, Ralph Sperschneider, "Error concealment for compressed digital audio", Audio Engineering Society 111th Convention, Sep. 24, 2001.

Sang-Uk Ryu, Kenneth Roseh, "An MDCT Domain Frame-Loss Concealment Technique for MPEG Advanced Audio Coding", IEEE International Conference on Acoustics, Speech and Signal Processing-ICASSP, Jul. 2007.

International Standard—ISO/IEC 11172-3:1993 (E)—"Information Technology—Coding of moving pictures and associated audio for digital storage media at up to about 1,5 Mbit/s—Part 3: Audio", Geneva, First edition, Aug. 1, 1993. (158 pages).

3GPP TS 26.290 V9.0.0., 3rd Generation Partnership Project; Technical Specification Group Services and System Aspects; Audio codec processing functions; Extended Adaptive Multi-Rate-Wideband (AMR-WB+) codec. Transcoding functions (Release 9), Valbonne, Sep. 2009 (85 pages).

* cited by examiner

METHOD AND APPARATUS FOR OBTAINING SPECTRUM COEFFICIENTS FOR A REPLACEMENT FRAME OF AN AUDIO SIGNAL, AUDIO DECODER, AUDIO RECEIVER, AND SYSTEM FOR TRANSMITTING AUDIO SIGNALS

CROSS-REFERENCE TO RELATED APPLICATIONS

This application is a continuation of co-pending U.S. patent application Ser. No. 15/844,004 filed Dec. 15, 2017 which is a continuation of U.S. Pat. No. 9,916,834 granted Mar. 13, 2018, which is a continuation of International Application No. PCT/EP2014/063058, filed Jun. 20, 2014, all of which are incorporated herein by reference in their entirety, and additionally claims priority from European Applications Nos. EP13173161.4, filed Jun. 21, 2013, and EP 14167072.9, filed May 5, 2014, both of which are incorporated herein by reference in their entirety.

BACKGROUND OF THE INVENTION

The present invention relates to the field of the transmission of coded audio signals, more specifically to a method and an apparatus for obtaining, or acquiring, spectrum coefficients for a replacement frame of an audio signal, to an audio decoder, to an audio receiver and to a system for transmitting audio signals. Embodiments relate to an approach for constructing a spectrum for a replacement frame based on previously received frames.

In conventional technology, several approaches are described dealing with a frame-loss at an audio receiver. For example, when a frame is lost on the receiver side of an audio or speech codec, simple methods for the frame-loss-concealment as described in P. Lauber and R. Sperschneider, "Error Concealment for Compressed Digital Audio," in *AES 111th Convention*, New York, USA, 2001 (hereinafter "the Lauber reference") may be used, such as:

repeating the last received frame,
muting the lost frame, or
sign scrambling.

Additionally, in the Lauber reference, an advanced technique using predictors in sub-bands is presented. The predictor technique is then combined with sign scrambling, and the prediction gain is used as a sub-band wise decision criterion to determine which method will be used for the spectral coefficients of this sub-band.

In U.S. Pat. No. 6,351,730 B2 (C. J. Hwey, "Low-complexity, low-delay, scalable and embedded speech and audio coding with adaptive frame loss concealment," hereinafter "the '730 Patent"), a waveform signal extrapolation in the time domain is used for a MDCT (Modified Discrete Cosine Transform) domain codec. This kind of approach may be good for monophonic signals including speech.

If one frame delay is allowed, an interpolation of the surrounding frames can be used for the construction of the lost frame. Such an approach is described in US Patent Application Publication No. 2007/094009 A1 (S. K. Gupta, E. Choy and S.-U. Ryu, "Encoder-assisted frame loss concealment techniques for audio coding," hereinafter "the '009 Publication"), where the magnitudes of the tonal components in the lost frame with an index m are interpolated using the neighboring frames indexed m−1 and m+1. The side information that defines the MDCT coefficient signs for tonal components is transmitted in the bit-stream. Sign scrambling is used for other non-tonal MDCT coefficients.

The tonal components are determined as a predetermined fixed number of spectral coefficients with the highest magnitudes. This approach selects n spectral coefficients with the highest magnitudes as the tonal components.

$$C_m^*(k)=\tfrac{1}{2}(C_{m-1}(k)+)$$

$$C_{m+1}(k)$$

FIG. 7 shows a block diagram representing an interpolation approach without transmitted side information as it is for example described in S.-U. Ryu and K. Rose, "A Frame Loss Concealment Technique for MPEG-AAC," in 120*th AES Convention*, Paris, France, 2006 (hereinafter "Ryu 2006/Paris". The interpolation approach operates on the basis of audio frames coded in the frequency domain using MDCT (modified discrete cosine transform). A frame interpolation block 700 receives the MDCT coefficients of a frame preceding the lost frame and a frame following the lost frame, more specifically in the approach described with regard to FIG. 7, the MDCT coefficients $C_{m-1}$ (k) of the preceding frame and the MDCT coefficients $C_{m+1}$ (k) of the following frame are received at the frame interpolation block 700. The frame interpolation block 700 generates an interpolated MDCT coefficient $\overline{C}_m$ (k) for the current frame which has either been lost at the receiver or cannot be processed at the receiver for other reasons, for example due to errors in the received data or the like. The interpolated MDCT coefficient $\overline{C}_m$ (k) output by the frame interpolation block 700 is applied to block 702 causing a magnitude scaling in scale factor band and to block 704 causing a magnitude scaling with an index set, and the respective blocks 702 and 704 output the MDCT coefficient $\overline{C}_m$ (k) scaled by the factor $\hat{\alpha}$ (k) and $\tilde{\alpha}$(k), respectively. The output signal of block 702 is input into the pseudo spectrum block 706 generating on the basis of the received input signal the pseudo spectrum $\hat{P}_m$ (k) that is input into the peak detection block 708 a signal indicating detected peaks. The signal provided by block 702 is also applied to the random sign change block 712 which, responsive to the peak detection signal generated by block 708, causes a sign change of the received signal and outputs a modified MDCT coefficient $\hat{C}_m$ (k) to the spectrum composition block 710. The scaled signal provided by block 704 is applied to a sign correction block 714 causing, in response to the peak detection signal provided by block 708 a sign correction of the scaled signal provided by block 704 and outputting a modified MDCT coefficient $\tilde{C}_m$ (k) to the spectrum composition block 710 which, on the basis of the received signals, generates the interpolated MDCT coefficient $C_m^*$(k) that is output by the spectrum composition block 710. As is shown in FIG. 7, the peak detection signal provided by block 708 is also provided to block 704 generating the scaled MDCT coefficient.

FIG. 7 generates at the output of the block 714 the spectral coefficients $\tilde{C}_m$ (k) for the lost frame associated with tonal components, and at the output of the block 712 the spectral coefficients $\hat{C}_m$ (k) for non-tonal components are provided so that at the spectrum composition block 710 on the basis of the spectral coefficients received for the tonal and non-tonal components the spectral coefficients for the spectrum associated with the lost frame are provided.

The operation of the FLC (Frame Loss Concealment) technique described in the block diagram of FIG. 7 will now be described in further detail.

In FIG. 7, basically, four modules can be distinguished:

a shaped-noise insertion module (including the frame interpolation 700, the magnitude scaling within the scale factor band 702 and the random sign change 712), a MDCT bin classification module (including the pseudo spectrum 706 and the peak detection 708), a tonal concealment operations module (including the magnitude scaling within the index set 704 and the sign correction 714), and the spectrum composition 710.

The approach is based on the following general formula:

$$C_m(k)=C_m^*(k)\alpha^*(k)s^*(k), 0\leq k<M$$

$C_m^*(k)$ is derived by a bin-wise interpolation (see block 700 "Frame Interpolation"):

$$C_m^*(k)=\tfrac{1}{2}(C_{m-1}(k)+C_{m+1}(k))$$

$\alpha^*(k)$ is derived by an energy interpolation using the geometric mean:

scale factor band wise for all components, (see block 702 "Magnitude Scaling in Scalefactor Band") and index sub-set wise for tonal components (see block 704 "Magnitude Scaling within Index Set"):

$$(\alpha^*)^2(k)=\frac{\sqrt{E_{m+1}E_{m-1}}}{E_m}$$

For tonal components it can be shown that $\alpha=\cos(\pi f_l)$, with $f_l$ being the frequency of the tonal component.

The energies E are derived based on a pseudo power spectrum, derived by a simple smoothing operation:

$$P(k)\cong C^2(k)+\{C(k+1)-C(k-1)\}^2$$

$s^*(k)$ is set randomly to ±1 for non-tonal components (see block 712 "Random Sign Change"), and to either +1 or −1 for tonal components (see block 714 "Sign Correction").

The peak detection is performed as searching for local maxima in the pseudo power spectrum to detect the exact positions of the spectral peaks corresponding to the underlying sinusoids. It is based on the tone identification process adopted in the MPEG-1 psychoacoustic model described in ISO/IEC JTC1/SC29/WG11, *Information technology—Coding of moving pictures and associated*, International Organization for Standardization, 1993. Out of this, an index sub-set is defined having the bandwidth of an analysis window's main-lobe in terms of MDCT bins and the detected peak in its center. Those bins are treated as tone dominant MDCT bins of a sinusoid, and the index sub-set is treated as an individual tonal component.

The sign correction $s^*(k)$ flips either the signs of all bins of a certain tonal component, or none. The determination is performed using an analysis by synthesis, i.e., the SFM is derived for both versions and the version with the lower SFM is chosen. For the SFM derivation, the power spectrum is needed, which in return may use the MDST (Modified Discrete Sine Transform) coefficients. For keeping the complexity manageable, only the MDST coefficients for the tonal component are derived, using also only the MDCT coefficients of this tonal component.

FIG. 8 shows a block diagram of an overall FLC technique which, when compared to the approach of FIG. 7, is refined and which is described in S.-U. Ryu and R. Kenneth, *An MDCT domain frame-loss concealment technique for MPEG Advanced Audio Coding*, Department od Electrical and Computer Engineering, University of California, 2007 (hereinafter "Ryu 2007"). In FIG. 8, the MDCT coefficients $C_{m-1}$ and $C_{m+1}$ of a last frame preceding the lost frame and a first frame following the lost frame are received at an MDCT bin classification block 800. These coefficients are also provided to the shape-noise insertion block 802 and to the MDCT estimation for a tonal components block 804. At block 804 also the output signal provided by the classification block 800 is received as well as the MDCT coefficients $C_{m-2}$ and $C_{m+2}$ of the second to last frame preceding the lost frame and the second frame following the lost frame, respectively, are received. The block 804 generates the MDCT coefficients $\tilde{C}_m$ of the lost frame for the tonal components, and the shape-noise insertion block 802 generates the MDCT spectral coefficients for the lost frame $\hat{C}_m$ for non-tonal components. These coefficients are supplied to the spectrum composition block 806 generating at the output the spectral coefficients $C_m^*$for the lost frame. The shape-noise insertion block 802 operates in reply to the system $I_T$ generated by the estimation block 804.

The following modifications are of interest with respect to the Ryu 2006/Paris reference:

The pseudo power spectrum used for the peak detection is derived as $$P_m(k)=C_{m-1}^2(k)+C_{m+1}^2(k)$$

To eliminate perceptually irrelevant or spurious peaks, the peak detection is only applied to a limited spectral range and only local maxima that exceed a relative threshold to the absolute maximum of the pseudo power spectrum are considered. The remaining peaks are sorted in descending order of their magnitude, and a pre-specified number of top-ranking maxima are classified as tonal peaks.

The approach is based on the following general formula (with α being signed this time):

$$C_m(k)=C_m^*(k)\alpha(k),\ 0\leq k<M$$

$C_m^*(k)$ is derived as above, but the derivation of a becomes more advanced, following the approach $$E_m(\alpha)=\tfrac{1}{2}\{E_{m-1}(\alpha)+E_{m+1}(\alpha)\}$$

Substituting $E_m$, $E_{m-1}$, and $E_{m+1}$ with $$E_{m-1}(\alpha)\cong|c_{m-1}|^2+|s_{m-1}|^2=|c_{m-1}|^2+|\xi_1+\alpha\zeta_1|^2$$

$$E_m(\alpha)\cong\alpha^2|c_m|^2+|s_m|^2=\alpha^2|c_m|^2+|\xi_2+\alpha\zeta_2|^2$$

$$E_{m+1}(\alpha)\cong|c_{m+1}|^2+|s_{m+1}|^2=|c_{m+1}|^2+|\xi_3+\alpha\zeta_3|^2$$

whereas $$s_{m-1}\cong A_1c_{m-2}+A_2c_{m-1}+\alpha A_3c_m=\xi_1+\alpha\zeta_1$$

$$s_m\cong A_1c_{m-1}+\alpha_l A_2c_m+A_3c_{m+1}=\xi_2+\alpha\zeta_2$$

$$s_{m+1}\cong\alpha A_1c_m+A_2c_{m+1}+A_3c_{m+2}=\xi_3+\alpha\zeta_3$$

yields an expression that is quadratic in α. Hence, for the given MDCT estimate there exist two candidates (with opposite signs) for the multiplicative correction factor ($A_1$, $A_2$, $A_3$ are the transformation matrices). The selection of the better estimate is performed similar to what is described in the Ryu 2006/Paris reference.

This advanced approach may use two frames before and after the frame loss in order to derive the MDST coefficients of the previous and the subsequent frame.

A delay-less version of this approach is suggested in S.-U. Ryu, *Source Modeling Approaches to Enhanced Decoding in Lossy Audio Compression and Communication*, UNIVERSITY of CALIFORNIA Santa Barbara, 2006 (hereinafter "Ryu 2006/California"):

As a starting point, the interpolation formula $C_m^*(k)=\tfrac{1}{2}(C_{m-1}(k)+C_{m+1}(k))$ is reused, but is applied for the frame m−1, resulting in:

$$C_m(k)=2C_{m-1}^*(k)-C_{m-2}(k)$$

Then, the interpolation result $C_{m-1}$*is replaced by the true estimation (here, the factor 2 becomes part of the correction factor: $\alpha=2\cos(\pi f_l)$), which leads to $$C_m(k)=\alpha C_{m-1}(k)-C_{m-2}(k)$$

The correction factor is determined by observing the energies of two previous frames. From the energy computation, the MDST coefficients of the previous frame are approximated as $$s_{m-1}\cong(A_1-A_3)c_{m-2}+A_2c_{m-1}+\alpha A_3c_{m-1}=\xi_0+\alpha\zeta_0$$

Then, the sinusoidal energy is computed as $$E_{m-1}(\alpha)\cong|c_{m-1}|^2+|s_{m-1}|^2=|c_{m-1}|^2+|\xi_0+\alpha\zeta_0|^2$$

Similarly, the sinusoidal energy for frame m−2 is computed and denoted by $E_{m-2}$, which is independent of $\alpha$. Employing the energy requirement $$E_{m-1}(\alpha)=E_{m-2}$$

yields again an expression that is quadratic in $\alpha$.

The selection process for the candidates computed is performed as before, but the decision rule accounts only the power spectrum of the previous frame.

Another delay-less frame-loss-concealment in the frequency domain is described in European Patent No. EP 0574288 B1 (M. Yannick, "Method and apparatus for transmission error concealment of frequency transform coded digital audio signals," hereinafter "the '288 Patent". The teachings of reference the '288 Patent can be simplified, without loss of generality, as:

Prediction using a DFT of a time signal:

(a) Obtain the DFT spectrum from the decoded time domain signal that corresponds to the received coded frequency domain coefficients $C_m$.

(b) Modulate the DFT magnitudes, assuming a linear phase change, to predict the missing frequency domain coefficients in the next frame $C_{m+1}$.

Prediction using a magnitude estimation from the received frequency spectra:

(a) Find $C_m'$ and $S_m'$, using $C_m$ as input, such that $$C_m'(k)=Q_m(k)\cos(\varphi_m(k)+\chi)$$

$$S_m'(k)=Q_m(k)\sin(\varphi_m(k)+\chi)$$

where $Q_m(k)$ is the magnitude of the DFT coefficient that corresponds to $C_m(k)$.

(b) Calculate:

$$Q_m(k)=\sqrt{|C_m'(k)|^2+|S_m'(k)|^2}$$

$$\varphi_m(k)=\arccos\frac{C_m(k)}{Q_m(k)}$$

(c) Perform a linear extrapolation of the magnitude and the phase:

$$Q_{m+1}(k)=2Q_m(k)-Q_{m-1}(k)$$

$$\varphi_{m+1}(k)=2\varphi_m(k)-\varphi_{m-1}(k)$$

$$C_{m+1}(k)=Q_{m+1}(k)\cos(\varphi_{m+1}(k))$$

Use filters to calculate $C_m'$ and $S_m'$ from $C_m$ and then proceed as above to get $C_{m+1}(k)$ Use an adaptive filter to calculate $C_{m+1}(k)$:

$$C_{m+1}(k)=\sum_{i=0}^{l}a_{m,i}(k)+C_{m-i}(k)$$

The selection of spectrum coefficients to be predicted is mentioned in the '288 Patent but is not described in detail.

In Y. Mahieux, J.-P. Petit and A. Charbonnier, "Transform coding of audio signals using correlation between successive transform blocks," in *Acoustics, Speech, and Signal Processing,* 1989. ICASSP-89, 1989, it has been recognized that, for quasi-stationary signals, the phase difference between successive frames is almost constant and depends only on the fractional frequency. However, only a linear extrapolation from the last two complex spectra is used.

In AMR-WB+ (see 3GPP; Technical Specification Group Services and System Aspects, *Extended Adaptive Multi-Rate—Wideband* (*AMR-WB+*) *codec,* 2009) a method described in U.S. Pat. No. 7,356,748 B2 (A. Taleb, "Partial Spectral Loss Concealment in Transform Codecs," hereinafter "the '748 Patent") is used. The method in the '748 Patent is an extension of the method described in reference the '288 Patent in a sense that it uses also the available spectral coefficients of the current frame, assuming that only a part of the current frame is lost. However, the situation of a complete loss of a frame is not considered in the '748 Patent.

Another delay-less frame-loss-concealment in the MDCT domain is described in US Patent Application Publication No. 2012/109659 A1 (C. Guoming, D. Zheng, H. Yuan, J. Li, J. Lu, K. Liu, K. Peng, L. Zhibin, M. Wu and Q. Xiaojun, "Compensator and Compensation Method for Audio Frame Loss in Modified Discrete Cosine Transform Domain," hereinafter "the '659 Publication". In the '659 Publication, it is first determined if the lost $P_{th}$ frame is a multiple-harmonic frame. The lost $P_{th}$ frame is a multiple-harmonic frame if more than $K_o$ frames among K frames before the $P_{th}$ frame have a spectrum flatness smaller than a threshold value. If the lost $P_{th}$ frame is a multiple-harmonic frame then $(P-K)_{th}$ to $(P-2)_{nd}$ frames in the MDCT-MDST domain are used to predict the lost $P_{th}$ frame. A spectral coefficient is a peak if its power spectrum is bigger than the two adjacent power spectrum coefficients. A pseudo spectrum as described in L. S. M. Dauder, "MDCT Analysis of Sinusoids: Exact Results and Applications to Coding Artifacts Reduction," *IEEE TRANSACTIONS ON SPEECH AND AUDIO PROCESSING*, pp. 302-312, 2004 (hereinafter "Dauder"), is used for the $(P-1)_{st}$ frame.

A set of spectral coefficients $S_c$ is constructed from $L_1$ power spectrum frames as follows.

Obtaining $L_1$ sets $S_1, \ldots, S_{L1}$ composed of peaks in each of $L_1$ frames, a number of peaks in each set being $N_1, \ldots, N_{L1}$, respectively. Selecting a set $S_i$ from the $L_1$ sets of $S_1, \ldots, S_{L1}$. For each peak coefficient mj, j=1 . . . $N_i$ in the set $S_1$, judging whether there is any frequency coefficient among $m_j, m_{j\pm1}, \ldots, m_{j\pm k}$ belonging to all other peak sets. If there is any, putting all the frequencies $m_j, m_{j\pm1}, \ldots, m_{j\pm k}$ into the frequency set $S_c$. If there is no frequency coefficient belonging to all other peak sets, directly putting all the frequency coefficients in a frame into the frequency set $S_c$. Said k is a nonnegative integer. For all spectral coefficients in the set $S_c$ the phase is predicted using $L_2$ frames among $(P-K)_{th}$ to $(P-2)_{nd}$ MDCT-MDST frames. The prediction is done using a linear extrapolation (when $L_2=2$) or a linear fit (when $L_2>2$). For the linear extrapolation:

$$\hat{\varphi}^p(m)=\varphi^{t1}(m)+\frac{p-t1}{t1-t2}[\varphi^{t1}(m)-\varphi^{t2}(m)]$$

where p, t1 and t2 are frame indices.

The spectral coefficients not in the set $S_c$ are obtained using a plurality of frames before the $(P-1)_{st}$ frame, without specifically explaining how.

SUMMARY

According to one embodiment, a method for acquiring spectrum coefficients for a replacement frame of an audio signal may have the steps of: detecting a tonal component of a spectrum of an audio signal based on a peak that exists in the spectra of frames preceding a replacement frame; for the tonal component of the spectrum, predicting spectrum coefficients for the peak and its surrounding in the spectrum of the replacement frame; and for the non-tonal component of the spectrum, using a non-predicted spectrum coefficient for the replacement frame or a corresponding spectrum coefficient of a frame preceding the replacement frame. Optionally, a non-transitory computer program product may have a computer readable medium storing instructions which, when executed on a computer for the method.

According to another embodiment, an apparatus for acquiring spectrum coefficients for a replacement frame of an audio signal may have: a detector configured to detect a tonal component of a spectrum of an audio signal based on a peak that exists in the spectra of frames preceding a replacement frame; and a predictor configured to predict for the tonal component of the spectrum the spectrum coefficients for the peak and its surrounding in the spectrum of the replacement frame; wherein for the non-tonal component of the spectrum a non-predicted spectrum coefficient for the replacement frame or a corresponding spectrum coefficient of a frame preceding the replacement frame is used. In one configuration, an apparatus for acquiring spectrum coefficients for a replacement frame of an audio signal, the apparatus being configured to operate according to the method. In one alternative, an audio decoder may contain the apparatus for acquiring spectrum coefficients. Furthermore, the audio decoder may have an audio decoder for acquiring spectrum coefficients.

According to another embodiment, a system for transmitting audio signals may have: an encoder configured to generate coded audio signal; and a decoder configured to receive the coded audio signal, and to decode the coded audio signal.

Embodiments of a method for obtaining spectrum coefficients for a replacement frame of an audio signal include detecting a tonal component of a spectrum of an audio signal based on a peak that exists in the spectra of frames preceding a replacement frame; for the tonal component of the spectrum, predicting spectrum coefficients for the peak and its surrounding in the spectrum of the replacement frame; and for the non-tonal component of the spectrum, using a non-predicted spectrum coefficient for the replacement frame or a corresponding spectrum coefficient of a frame preceding the replacement frame.

Embodiments of an apparatus for obtaining spectrum coefficients for a replacement frame of an audio signal include a detector configured to detect a tonal component of a spectrum of an audio signal based on a peak that exists in the spectra of frames preceding a replacement frame; and a predictor configured to predict for the tonal component of the spectrum the spectrum coefficients for the peak and its surrounding in the spectrum of the replacement frame; wherein for the non-tonal component of the spectrum a non-predicted spectrum coefficient for the replacement frame or a corresponding spectrum coefficient of a frame preceding the replacement frame is used.

Embodiments of an apparatus for obtaining spectrum coefficients for a replacement frame of an audio signal include the apparatus being configured to operate according to the inventive method for obtaining spectrum coefficients for a replacement frame of an audio signal.

Embodiments of an apparatus include an audio decoder, comprising the inventive an apparatus for obtaining spectrum coefficients for a replacement frame of an audio signal.

Embodiments of an audio receiver may include the inventive audio decoder.

Embodiments of a system for transmitting audio signals include an encoder configured to generate coded audio signal; and the inventive decoder configured to receive the coded audio signal, and to decode the coded audio signal.

Embodiments of a non-transitory computer program product include a computer readable medium storing instructions which, when executed on a computer, carry out the inventive method for obtaining spectrum coefficients for a replacement frame of an audio signal.

Embodiments of the systems, methods, and apparatuses are advantageous as they provide for a good frame-loss concealment of tonal signals with a good quality and without introducing any additional delay. Embodiments of a low delay codec are advantageous as they perform well on both speech and audio signals and benefits, for example in an error prone environment, from the good frame-loss concealment that is achieved especially for stationary tonal signals. A delay-less frame-loss-concealment of monophonic and polyphonic signals is disclosed, which delivers good results for tonal signals without degradation of the non-tonal signals.

In many embodiments, an improved concealment of tonal components in the MDCT domain is provided. Embodiments relate to audio and speech coding that incorporate a frequency domain codec or a switched speech/frequency domain codec, in particular to a frame-loss concealment in the MDCT (Modified Discrete Cosine Transform) domain. In many embodiments, a delay-less method for constructing an MDCT spectrum for a lost frame based on the previously received frames is provided, where the last received frame is coded in the frequency domain using the MDCT.

In one embodiment, a method includes detection of the parts of the spectrum which are tonal, for example using the second to last complex spectrum to get the correct location or place of the peak, using the last real spectrum to refine the decision if a bin is tonal, and using pitch information for a better detection either of a tone onset or offset. The pitch information is either already existing in the bit-stream or is derived at the decoder side. Further, embodiments of a method include a provision of a signal adaptive width of a harmonic to be concealed. The calculation of the phase shift or phase difference between frames of each spectral coefficient that is part of a harmonic is also provided, wherein this calculation is based on the last available spectrum, for example the CMDCT spectrum, without the need for the second to last CMDCT. In accordance with embodiments, the phase difference is refined using the last received MDCT spectrum, and the refinement may be adaptive, dependent on the number of consecutively lost frames. The CMDCT spectrum may be constructed from the decoded time domain signal which is advantageous as it avoids the need for any alignment with the codec framing, and it allows for the construction of the complex spectrum to be as close as possible to the lost frame by exploiting the properties of low-overlap windows. Embodiments provide a per frame decision to use either time domain or frequency domain concealment.

Embodiments of the inventive approach are advantageous, as they operate fully on the basis of information already available at the receiver side when determining that a frame has been lost or needs to be replaced and there is no need for additional side information that needs to be received so that there is also no source for additional delays which occur in conventional-technology approaches given the requirement to either receive the additional side information or to derive the additional side information from the existing information at hand.

Embodiments of the inventive approach are advantageous when compared to the above described conventional-technology approaches as the subsequently outlined drawbacks of such approaches, which were recognized by the inventors are avoided when applying the inventive approach.

The methods for the frame-loss-concealment described in the Lauber reference are not robust enough and don't produce good enough results for tonal signals.

The waveform signal extrapolation in time domain, as described in the '730 Patent, cannot handle polyphonic signals and uses an increased complexity for concealment of very stationary, tonal signals, as a precise pitch lag may be determined.

In the '009 Publication, an additional delay is introduced and significant side information may be used. The tonal component selection is very simple and will choose many peaks among non-tonal components.

The method described in the Ryu 2006/Paris reference may use a look-ahead on the decoder side and hence introduces an additional delay of one frame. Using the smoothed pseudo power spectrum for the peak detection reduces the precision of the location of the peaks. It also reduces the reliability of the detection since it will detect peaks from noise that appear in just one frame.

The method described in the Ryu 2007 reference may use a look-ahead on the decoder side and hence introduces an additional delay of two frames. The tonal component selection doesn't check for tonal components in two frames separately, but relies on an averaged spectrum, and thus it will have either too many false positives or false negatives making it impossible to tune the peak detection thresholds. The location of the peaks will not be precise because the pseudo power spectrum is used. The limited spectral range for peak search looks like a workaround for the described problems that arises because pseudo power spectrum is used.

The method described in the Ryu 2006/California reference is based on the method described in the Ryu 2007 reference; hence, it has the same drawbacks; it just overcomes the additional delay.

In the '288 Patent, there is no detailed description of the decision whether a spectral coefficient belongs to the tonal part of the signal. However, the synergy between the tonal spectral coefficients detection and the concealment is important and thus a good detection of tonal components is important. Further, it has not been recognized to use filters dependent on both $C_m$ and $C_{m-1}$ (that is $C_m$, $C_{m-1}$ and $S_{m-1}$, as $S_{m-1}$ can be calculated when $C_m$, and $C_{m-1}$ is available) to calculate $C_m'$ and $S_m'$. Also, it was not recognized to use the possibility to calculate a complex spectrum that is not aligned to the coded signal framing, which is given with low overlap windows. In addition, it was not recognized to use the possibility to calculate the phase difference between frames only based on the second last complex spectrum.

In the '659 Publication, at least three previous frames are stored in memory, thereby significantly increasing the memory requirements. The decision whether to use tonal concealment may be wrong and a frame with one or more harmonics may be classified as a frame without multiple harmonics. The last received MDCT frame is not directly used to improve the prediction of the lost MDCT spectrum, but just in the search for the tonal components. The number of MDCT coefficients to be concealed for a harmonic is fixed, however, depending on the noise level, it is desirable to have a variable number of MDCT coefficients that constitute one harmonic.

BRIEF DESCRIPTION OF THE DRAWINGS

Embodiments of the present invention will be detailed subsequently referring to the appended drawings, in which.

DETAILED DESCRIPTION OF THE INVENTION

In the following, embodiments of the inventive approach will be described in further detail and it is noted that in the accompanying drawings elements having the same or similar functionality are denoted by the same reference signs. In the following embodiments of the inventive approach will be described, in accordance with which a concealment is done in the frequency domain only if the last two received frames are coded using the MDCT. Details about the decision whether to use time or frequency domain concealment on a frame loss after receiving two MDCT frames will also be described. With regard to the embodiments described in the following it is noted that the requirement that the last two frames are coded in the frequency domain does not reduce the applicability of the inventive approach as in a switched codec the frequency domain will be used for stationary tonal signals.

Figure 1:
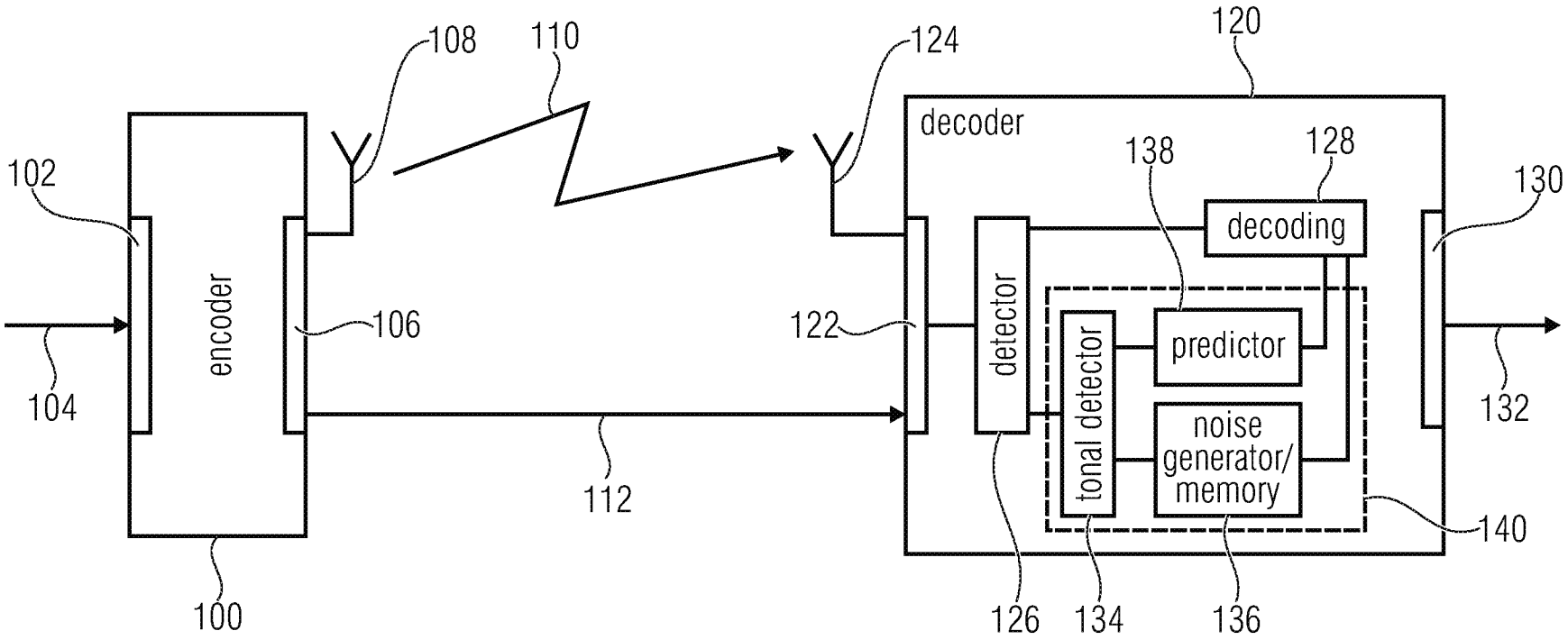
FIG. 1 shows a simplified block diagram of a system for transmitting audio signals implementing the inventive approach at the decoder side.

FIG. 1 shows a simplified block diagram of a system for transmitting audio signals implementing the inventive approach at the decoder side. The system comprises an encoder 100 receiving at an input 102 an audio signal 104. The encoder is configured to generate, on the basis of the received audio signal 104, an encoded audio signal that is provided at an output 106 of the encoder 100. The encoder may provide the encoded audio signal such that frames of the audio signal are coded using MDCT. In accordance with an embodiment the encoder 100 comprises an antenna 108 for allowing for a wireless transmission of the audio signal, as is indicated at reference sign 110. In other embodiments, the encoder may output the encoded audio signal provided at the output 106 via a wired connection line, as it is for example indicated at reference sign 112.

The system further comprises a decoder 120 having an input 122 at which the encoded audio signal provided by the encoder 106 is received. The encoder 120 may comprise, in accordance with an embodiment, an antenna 124 for receiving a wireless transmission 110 from the encoder 100. In another embodiment, the input 122 may provide for a connection to the wired transmission 112 for receiving the encoded audio signal. The audio signal received at the input 122 of the decoder 120 is applied to a detector 126 which determines whether a coded frame of the received audio signal that is to be decoded by the decoder 120 needs to be replaced. For example, in accordance with embodiments, this may be the case when the detector 126 determines that a frame that should follow a previous frame is not received at the decoder or when it is determined that the received frame has errors which avoid decoding it at the decoder side 120. In case it is determined at detector 126 that a frame presented for decoding is available, the frame will be forwarded to the decoding block 128 where a decoding of the encoded frame is carried out so that at the output of the decoder 130 a stream of decoded audio frames or a decoded audio signal 132 can be output.

In case it is determined at block 126 that the frame to be currently processed needs a replacement, the frames preceding the current frame which needs a replacement and which may be buffered in the detector circuitry 126 are provided to a tonal detector 134 determining whether the spectrum of the replacement includes tonal components or not. In case no tonal components are provided, this is indicated to the noise generator/memory block 136 which generates spectral coefficients which are non-predictive coefficients which may be generated by using a noise generator or another conventional noise generating method, for example sign scrambling or the like. Alternatively, also predefined spectrum coefficients for non-tonal components of the spectrum may be obtained from a memory, for example a look-up table. Alternatively, when it is determined that the spectrum does not include tonal components, instead of generating non-predicted spectral coefficients, corresponding spectral characteristics of one of the frames preceding the replacement may be selected.

In case the tonal detector 134 detects that the spectrum includes tonal components, a respective signal is indicated to the predictor 138 predicting, in accordance with embodiments of the present invention described later, the spectral coefficients for the replacement frame. The respective coefficients determined for the replacement frame are provided to the decoding block 128 where, on the basis of these spectral coefficients, a decoding of the lost or replacement frame is carried out.

As is shown in FIG. 1, the tonal detector 134, the noise generator 136 and the predictor 138 define an apparatus 140 for obtaining spectral coefficients for a replacement frame in a decoder 120. The depicted elements may be implemented using hardware and/or software components, for example appropriately programmed processing units.

Figure 2:
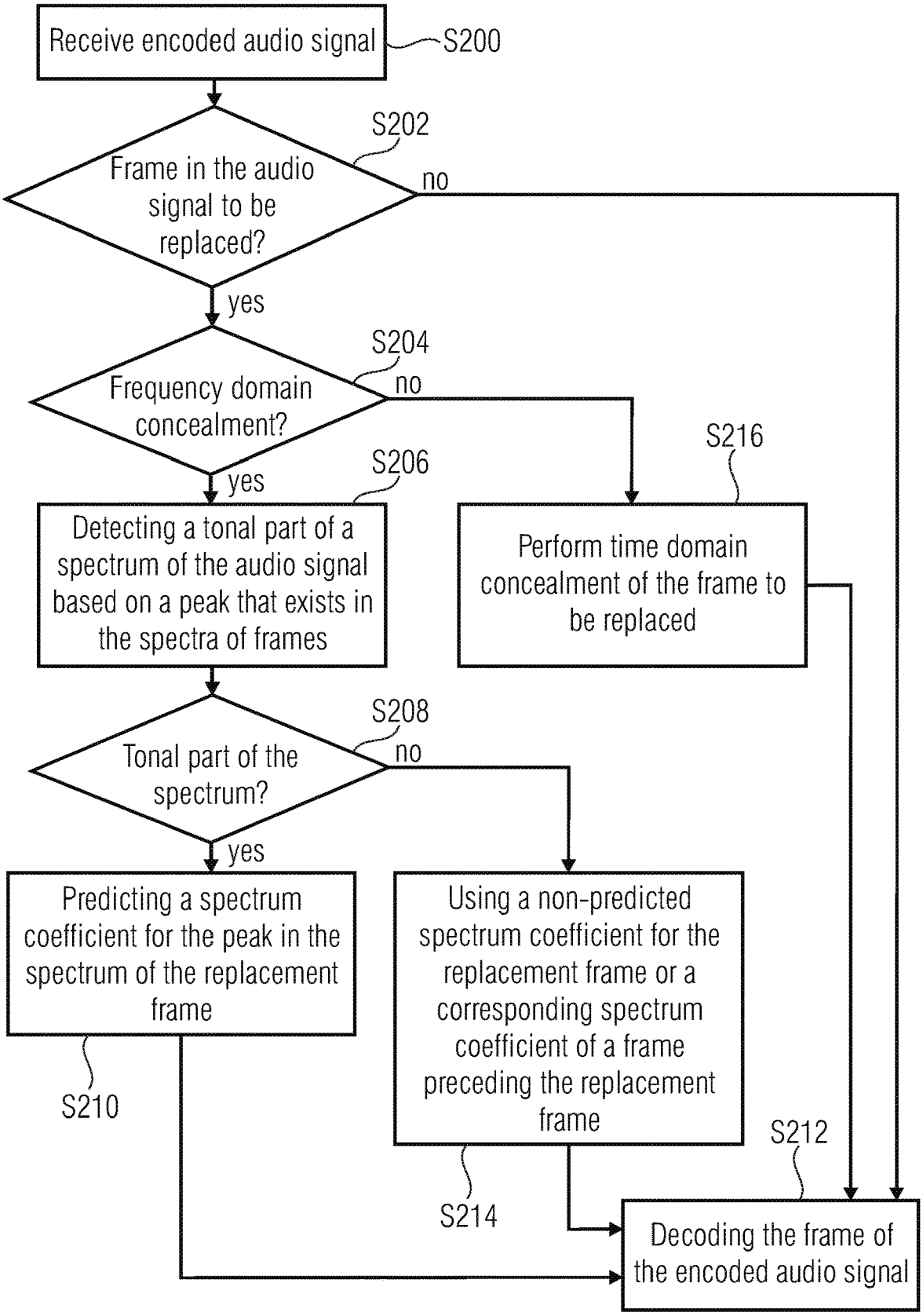
FIG. 2 shows a flow diagram of the inventive approach in accordance with an embodiment.

FIG. 2 shows a flow diagram of the inventive approach in accordance with an embodiment. In a first step S200 an encoded audio signal is received, for example at a decoder 120 as it is depicted in FIG. 1. The received audio signal may be in the form of respective audio frames which are coded using MDCT.

In step S202 it is determined whether or not a current frame to be processed by the decoder 120 needs to be replaced. A replacement frame may be used at the decoder side, for example in case the frame cannot be processed due to an error in the received data or the like, or in case the frame was lost during transmission to the receiver/decoder 120, or in case the frame was not received in time at the audio signal receiver 120, for example due to a delay during transmission of the frame from the encoder side towards the decoder side.

In case it is determined in step S202, for example by the detector 126 in decoder 120, that the frame to be currently processed by the decoder 120 needs to be replaced, the method proceeds to step S204 at which a further determination is made whether or not a frequency domain concealment may be used. In accordance with an embodiment, if the pitch information is available for the last two received frames and if the pitch is not changing, it is determined at step S204 that a frequency domain concealment is desired. Otherwise, it is determined that a time domain concealment should be applied. In an alternative embodiment, the pitch may be calculated on a sub-frame basis using the decoded signal, and again using the decision that in case the pitch is present and in case it is constant in the sub-frames, the frequency domain concealment is used, otherwise the time domain concealment is applied.

In yet another embodiment of the present invention, a detector, for example the detector 126 in decoder 120, may be provided and may be configured in such a way that it additionally analyzes the spectrum of the second to last frame or the last frame or both of these frames preceding the replacement frame and to decide, based on the peaks found, whether the signal is monophonic or polyphonic. In case the signal is polyphonic, the frequency domain concealment is to be used, regardless of the presence of pitch information. Alternatively, the detector 126 in decoder 120, may be configured in such a way that it additionally analyzes the one or more frames preceding the replacement frame so as to indicate whether a number of tonal components in the signal exceeds a predefined threshold or not. In case the number of tonal components in the signal exceeds the threshold the frequency domain concealment will be used.

In case it is determined in step S204 that a frequency domain concealment is to be used, for example by applying the above mentioned criteria, the method proceeds to step S206, where a tonal part or a tonal component of a spectrum of the audio signal is detected based on one or more peaks that exist in the spectra of the preceding frames, namely one or more peaks that are present at substantially the same location in the spectrum of the second to last frame and the spectrum of the last frame preceding the replacement frame. In step S208 it is determined whether there is a tonal part of the spectrum. In case there is a tonal part of the spectrum, the method proceeds to step S210, where one or more spectrum coefficients for the one or more peaks and their surroundings in the spectrum of the replacement frame are predicted, for example on the basis of information derivable from the preceding frames, namely the second to last frame and the last frame. The spectrum coefficient(s) predicted in step S210 is (are) forwarded, for example to the decoding block 128 shown in FIG. 1, so that, as is shown at step 212, decoding of the frame of the encoded audio signal on the basis of the spectrum coefficients from step 210 can be performed.

In case it is determined in step S208 that there is no tonal part of the spectrum, the method proceeds to step S214, using a non-predicted spectrum coefficient for the replacement frame or a corresponding spectrum coefficient of a frame preceding the replacement frame which are provided to step S212 for decoding the frame.

In case it is determined in step S204 that no frequency domain concealment is desired, the method proceeds to step S216 where a conventional time domain concealment of the frame to be replaced is performed and on the basis of the spectrum coefficients generated by the process in step S216 the frame of the encoded signal is decoded in step S212.

In case it is determined at step S202 that there is no replacement frame in the audio signal currently processed, i.e. the currently processed frame can be fully decoded using the conventional approaches, the method directly proceeds to step S212 for decoding the frame of the encoded audio signal.

In the following, further details in accordance with embodiments of the present invention will be described.

Power Spectrum Calculation

For the second-last frame, indexed m−2, the MDST coefficients $S^{m-2}$ are calculated directly from the decoded time domain signal.

For the last frame an estimated MDST spectrum is used which is calculated from the MDCT coefficients $C_{m-1}$ of the last received frame (see e.g., the Dauder reference):

$$|S_{m-1}(k)|=|C_{m-1}(k+1)-C_{m-1}(k-1)|$$

The power spectra for the frames m−2 and m−1 are calculated as follows:

$$P_{m-2}(k)=|S_{m-2}(k)|^2+|C_{m-2}(k)|^2$$

$$P_{m-1}(k)=|S_{m-1}(k)|^2+|C_{m-1}(k)|^2$$

with:

$S_{m-1}$(k) MDST coefficient in frame m−1, $C_{m-1}$(k) MDCT coefficient in frame m−1, $S_{m-2}$(k) MDST coefficient in frame m−2, and $C_{m-2}$ (k) MDCT coefficient in frame m−2.

The obtained power spectra are smoothed as follows:

$$P\text{smoothed}_{m-2}(k)=0.75\cdot P_{m-2}(k-1)+P_{m-2}(k)+0.75\cdot P_{m-2}(k+1)$$

$$P\text{smoothed}_{m-1}(k)=0.75\cdot P_{m-1}(k-1)+P_{m-1}(k)+0.75\cdot P_{m-1}(k+1).$$

Detection of Tonal Components

Peaks existing in the last two frames (m−2 and m−1) are considered as representatives of tonal components. The continuous existence of the peaks allows for a distinction between tonal components and randomly occurring peaks in noisy signals.

Pitch Information

It is assumed that the pitch information is available:

calculated on the encoder side and available in the bit-stream, or calculated on the decoder side.

The pitch information is used only if all of the following conditions are met:

the pitch gain is greater than zero;

the pitch lag is constant in the last two frames; and the fundamental frequency is greater than 100 Hz.

The fundamental frequency is calculated from the pitch lag:

$$F_0 = \frac{2\cdot FrameSize}{PitchLag}$$

If there is $F_0'=n\cdot F_0$ for which N>5 harmonics are the strongest in the spectrum then $F_0$ is set to $F_0'$. $F_0$ is not reliable if there are not enough strong peaks at the positions of the harmonics $n\cdot F_0$.

Figure 3:
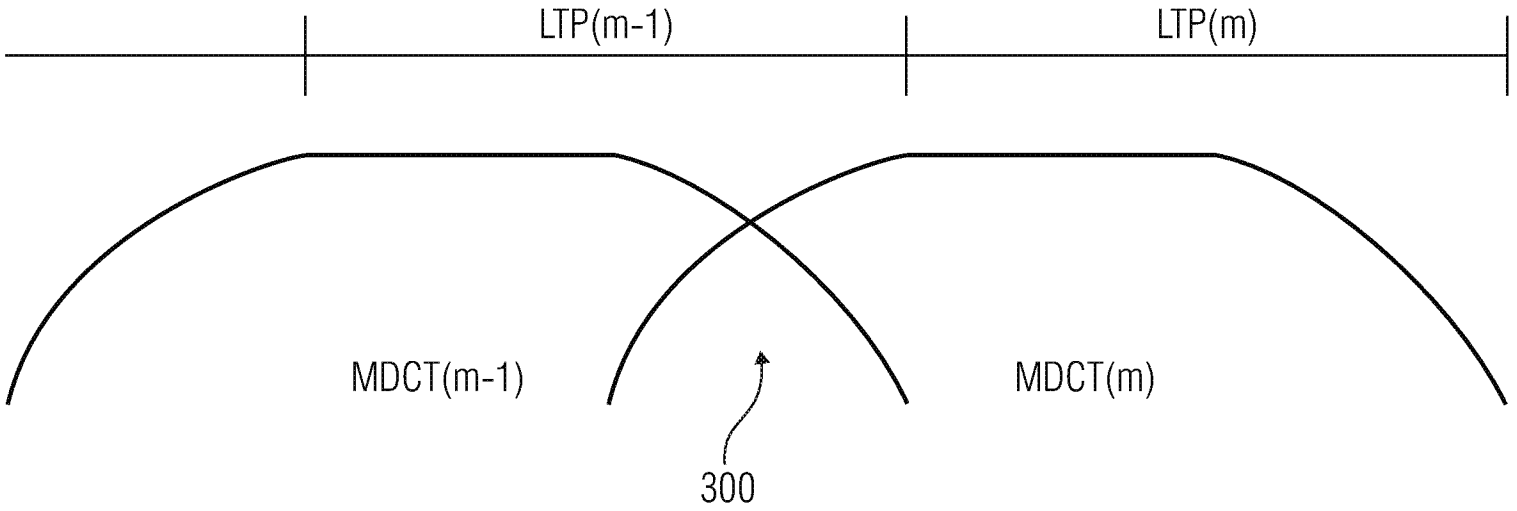
FIG. 3 is a schematic representation of the overlapping MDCT windows for neighboring frames.

In accordance with an embodiment, the pitch information is calculated on the framing aligned to the right border of the MDCT window shown in FIG. 3. This alignment is beneficial for the extrapolation of the tonal parts of a signal as the overlap region 300, being the part that may use concealment, is also used for pitch lag calculation.

In another embodiment, the pitch information may be transferred in the bit-stream and used by the codec in the clean channel and thus comes at no additional cost for the concealment.

Envelope

In the following a procedure is described for obtaining a spectrum envelope, which is needed for the peak picking described later.

The envelope of each power spectrum in the last two frames is calculated using a moving average filter of length L:

$$\text{Envelope}(k) = \sum_{i=k-\lfloor L/2\rfloor}^{k+\lfloor L/2\rfloor} P(i)$$

The filter length depends on the fundamental frequency (and may be limited to the range [7,23]):

$$L = \max\left(7, \min\left(23, 1 + 2 * \left\lfloor \frac{F_0}{2} \right\rfloor\right)\right)$$

This connection between L and $F_0$ is similar to the procedure described in D. B. Paul, "The Spectral Envelope Estimation Vocoder," IEEE Transactions on Acoustics, Speech, and Signal Processing, pp. 786-794, 1981 (hereinafter "Paul"); however, in the present invention the pitch information from the current frame is used that includes a look-ahead, wherein the Paul reference uses an average pitch specific to a talker. If the fundamental frequency is not available or not reliable, the filter length L is set to 15.

Peak Picking

Figure 4:
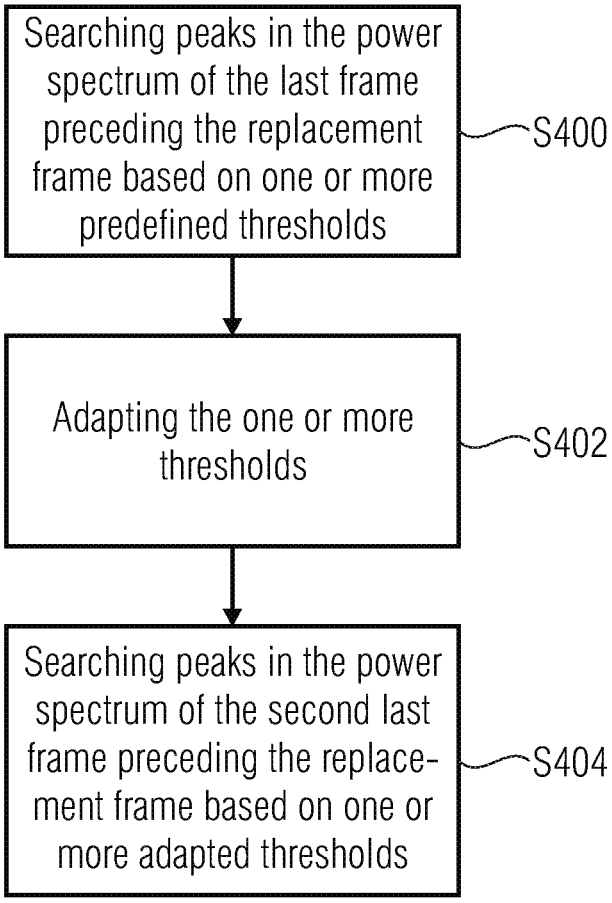
FIG. 4 shows a flow diagram representing the steps for picking a peak in accordance with an embodiment.

The peaks are first searched in the power spectrum of the frame m−1 based on predefined thresholds. Based on the location of the peaks in the frame m−1, the thresholds for the search in the power spectrum of the frame m−2 are adapted. Thus the peaks that exist in both frames (m−1 and m−2) are found, but the exact location is based on the power spectrum in the frame m−2. This order is important because the power spectrum in the frame m−1 is calculated using only an estimated MDST and thus the location of a peak is not precise. It is also important that the MDCT of the frame m−1 is used, as it is unwanted to continue with tones that exist only in the frame m−2 and not in the frame m−1. FIG. 4 shows a flow diagram representing the above steps for picking a peak in accordance with an embodiment. In step S400 peaks are searched in the power spectrum of the last frame m−1 preceding the replacement frame based on one or more predefined thresholds. In step S402, the one or more thresholds are adapted. In step S404 peaks are searched in the power spectrum of the second last frame m−2 preceding the replacement frame based on one or more adapted thresholds.

Figure 5:
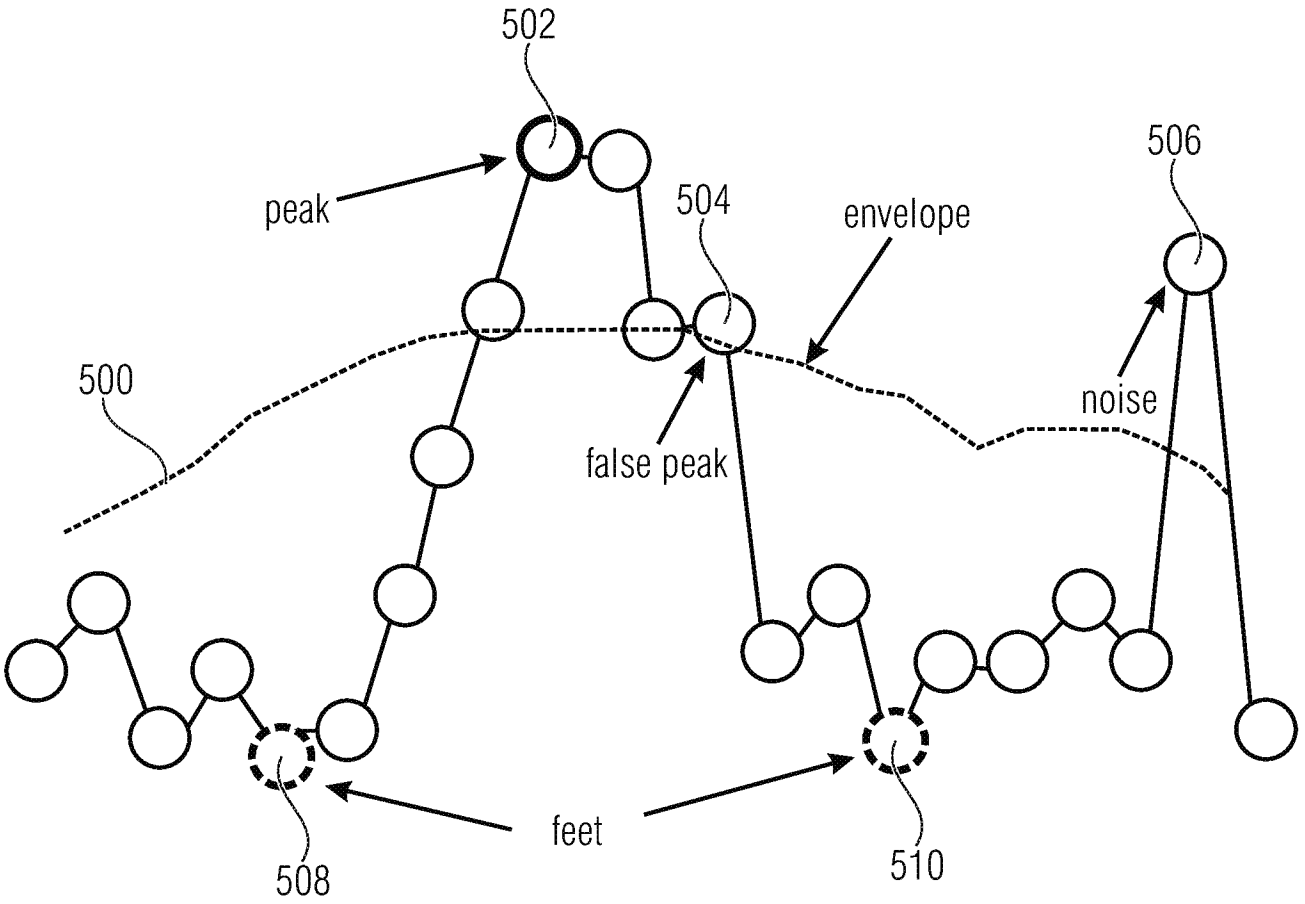
FIG. 5 is a schematic representation of a power spectrum of a frame from which one or more peaks are detected.

FIG. 5 is a schematic representation of a power spectrum of a frame from which one or more peaks are detected. In FIG. 5, the envelope 500 is shown which may be determined as outlined above or which may be determined by other known approaches. A number of peak candidates is shown which are represented by the circles in FIG. 5. Finding, among the peak candidate, a peak will be described below in further detail. FIG. 5 shows at a peak 502 that was found as well as a false peak 504 and a peak 506 representing noise. In addition, a left foot 508 and a right foot 510 of a spectral coefficient are shown.

In accordance with an embodiment, finding peaks in the power spectrum $P_{m-1}$ of the last frame m−1 preceding the replacement frame is done using the following steps (step S400 in FIG. 4):

a spectral coefficient is classified as a tonal peak candidate if all of the following criteria are met:

the ratio between the smoothed power spectrum and the envelope 500 is greater than a certain threshold:

$$10\cdot\log_{10}\left(\frac{Psmothed_{m-1}(k)}{Envelope_{m-1}(k)}\right) > 8.8\text{ dB},$$

the ratio between the smoothed power spectrum and the envelope 500 is greater than its surrounding neighbors, meaning it is a local maximum, local maxima are determined by finding the left foot 508 and the right foot 510 of a spectral coefficient k and by finding a maximum between the left foot 508 and the right foot 510. This step is used, as can be seen in FIG. 4, where the false peak 504 may be caused by a side lobe or by quantization noise.

The thresholds for the peak search in the power spectrum $P_{m-2}$ of the second last frame m−2 are set as follows (step S402 in FIG. 4):

in the spectrum coefficients k∈[i−1, 1+1] around a peak at an index i in $P_{m-1}$:

$$\text{Threshold}(k)=(P\text{smoothed}_{m-1}(k)>\text{Envelope}_{m-1}(k))\ ?9.21\text{ dB}:10.56\text{ dB},$$

if $F_0$ is available and reliable then for each n∈[1,N] set $k=\lfloor n\cdot F_0\rfloor$ and $\text{frac}=n\cdot F_0-k$:

$$\text{Threshold}(k)=8.8\text{ dB}+10\cdot\log_{10}(0.35)$$

$$\text{Threshold}(k-1)=8.8\text{ dB}+10\cdot\log_{10}(0.35+2\cdot\text{frac})$$

$$\text{Threshold}(k+1)=8.8\text{ dB}+10\cdot\log_{10}(0.35+2\cdot(1-\text{frac})),$$

if k∈[i−1,i+1] around a peak at index i in $P_{m-1}$ then the thresholds set in the first step are overwritten, for all other indices:

$$\text{Threshold}(k)=20.8\text{ dB}$$

Tonal peaks are found in the power spectrum $P_{m-2}$ of the second last frame m−2 by the following steps (step S404 in FIG. 4):

a spectral coefficient is classified as a tonal peak if:

the ratio of the power spectrum and the envelope is greater than the threshold:

$$10\cdot\log_{10}\left(\frac{Psmoothed_{m-2}(k)}{Envelope_{m-2}(k)}\right) > \text{Threshold}(k),$$

the ratio of the power spectrum and the envelope greater than its surrounding neighbors, meaning it is a local maximum, local maxima are determined by finding the left foot 508 and the right foot 510 of a spectral coefficient k and by finding a maximum between the left foot 508 and the right foot 510, the left foot 508 and the right foot 510 also define the surrounding of a tonal peak 502, i.e. the spectral bins of the tonal component where the tonal concealment method will be used.

Using the above described method, reveals that the right peak 506 in FIG. 4 only exists in one of the frames, i.e., it does not exist in both of frames m−1 or m−2. Therefore, this peak is marked as noise and is not selected as a tonal component.

Sinusoidal Parameter Extraction

For a sinusoidal signal $$x(t) = A\cdot\sin\left(\frac{2\pi}{N}(l+\Delta l)n+\phi\right)$$

a shift for N/2 (the MDCT hop size) results in the signal $$x(t) = A\cdot\sin\left(\frac{2\pi}{N}(l+\Delta l)\left(n+\frac{N}{2}\right)+\phi\right) = A\cdot\sin\left(\frac{2\pi}{N}(l+\Delta l)n+\pi(l+\Delta l)+\phi\right).$$

Thus, there is the phase shift $\Delta\varphi=\pi\cdot(l+\Delta l)$ where l is the index of a peak. Hence the phase shift depends on the fractional part of the input frequency plus an additional adding of π for odd spectral coefficients.

The fractional part of the frequency Δl can be derived using a method described, e.g., in A. Ferreira, "Accurate estimation in the ODFT domain of the frequency, phase and magnitude of stationary sinusoids," 2001 *IEEE Workshop on Applications of Signal Processing to Audio and Acoustics*, pp. 47-50, 2001:

given that the magnitude of the signal in sub-band k=l is a local maximum, Δl may be determined by computing the ratio of the magnitudes of the signal in the sub-bands k=l−1 and k=l+1, i.e., by evaluating:

$$\frac{\sqrt{P(l-1)}}{\sqrt{P(l+1)}} = \frac{H\left(\frac{2\pi}{N}\left(\Delta l+\frac{1}{2}\right)\right)}{H\left(\frac{2\pi}{N}\left(\Delta l-\frac{1}{2}\right)\right)}$$

where the approximation of the magnitude response of a window is used:

$$|\widehat{H(w)}| \cong \left(\cos\frac{N}{2b}w\right)^G,\ |w| < \frac{b\pi}{N}$$

where b is the width of the main lobe. The constant G in this expression has been adjusted to 27.4/20.0 in order to minimize the maximum absolute error of the estimation, substituting the approximated frequency response and letting $$R = \left[\frac{\sqrt{P(l-1)}}{\sqrt{P(l+1)}}\right]^{\frac{1}{G}} = \left[\frac{P(l-1)}{P(l+1)}\right]^{\frac{1}{2G}}$$

$$b' = 2\cdot b$$

leads to:

$$\Delta l = \frac{b'}{2\pi}\cdot\arctan\left(\frac{\cos\left(\frac{\pi}{b'}\right)-R\cdot\cos\left(\frac{3\pi}{b'}\right)}{\sin\left(\frac{\pi}{b'}\right)+R\cdot\sin\left(\frac{3\pi}{b'}\right)}\right).$$

MDCT Prediction

For all spectrum peaks found and their surroundings, the MDCT prediction is used. For all other spectrum coefficients sign scrambling or a similar noise generating method may be used.

All spectrum coefficients belonging to the found peaks and their surroundings belong to the set that is denoted as K. For example, in FIG. 5 the peak 502 was identified as a peak representing a tonal component. The surrounding of the peak 502 may be represented by a predefined number of neighboring spectral coefficients, for example by the spectral coefficients between the left foot 508 and the right foot 510 plus the coefficients of the feet 508, 510.

In accordance with embodiments, the surrounding of the peak is defined by a predefined number of coefficients around the peak 502. The surrounding of the peak may comprise a first number of coefficients on the left from the peak 502 and a second number of coefficients on the right from the peak 502. The first number of coefficients on the left from the peak 502 and the second number of coefficients on the right from the peak 502 may be equal or different.

In accordance with embodiments applying the EVS standard the predefined number of neighboring coefficients may be set or fixed in a first step, e.g. prior to detecting the tonal component. In the EVS standard three coefficients on the left from the peak 502, three coefficients on the right and the peak 502 may be used, i.e., all together seven coefficients (this number was chosen for complexity reasons, however, any other number will work as well).

In accordance with embodiments, the size of the surrounding of the peak is adaptive. The surroundings of the peaks identified as representing a tonal component may be modified such that the surroundings around two peaks don't overlap. In accordance with embodiments, a peak is usually considered only with its surrounding and they together define a tonal component.

For the prediction of the MDCT coefficients in a lost frame, the power spectrum (the magnitude of the complex spectrum) in the second last frame is used:

$$Q_{m-2}(k)=\sqrt{P_{m-2}(k)}=\sqrt{|S_{m-2}(k)|^2+|C_{m-2}(k)|^2}.$$

The lost MDCT coefficient in the replacement frame is estimated as:

$$C_m(k)=Q_{m-2}(k)\cdot\cos(\varphi_m(k)).$$

In the following a method for calculating the phase $\varphi_m$ (k) in accordance with an embodiment will be described.

Phase Prediction

For every spectrum peak found, the fractional frequency Δl is calculated as described above and the phase shift is:

$$\Delta\varphi=\pi\cdot(l+\Delta l).$$

Δφ is the phase shift between the frames. It is equal for the coefficients in a peak and its surrounding.

The phase for each spectrum coefficient at the peak position and the surroundings (k∈K) is calculated in the second last received frame using the expression:

$$\varphi_{m-2}(k)=\arctan\left(\frac{S_{m-2}(k)}{C_{m-2}(k)}\right).$$

The phase in the lost frame is predicted as:

$$\varphi_m(k)=\varphi_{m-2}(k)+2\Delta\varphi$$

In accordance with an embodiment, a refined phase shift may be used. Using the calculated phase $\varphi_{m-2}$(k) for each spectrum coefficient at the peak position and the surroundings allows for an estimation of the MDST in the frame m−1 which can be derived as:

$$S_{m-1}(k)=Q_{m-2}(k)\cdot\sin(\varphi_{m-2}(k)+\Delta\varphi(k))$$

with:

$Q_{m-2}$(k) power spectrum (magnitude of the complex spectrum) in frame m−2.

From this MDST estimation and from the received MDCT an estimation of the phase in the frame m−1 is derived:

$$\varphi_{m-1}(k)=\arctan\left(\frac{S_{m-1}(k)}{C_{m-1}(k)}\right).$$

The estimated phase is used to refine the phase shift:

$$\Delta\varphi(k)=\varphi_{m-1}(k)-\varphi_{m-2}(k)$$

with:

$\varphi_{m-1}$(k)—phase of the complex spectrum in frame m−1, and $\varphi_{m-2}$(k)—phase of the complex spectrum in frame m−2.

The phase in the lost frame is predicted as:

$$\varphi_m(k)=\varphi_{m-1}(k)+\Delta\varphi(k).$$

The phase shift refinement in accordance with this embodiment improves the prediction of sinusoids in the presence of a background noise or if the frequency of the sinusoid is changing. For non-overlapping sinusoids with constant frequency and without background noise the phase shift is the same for all of the MDCT coefficients that surround the peak.

The concealment that is used may have different fade out speeds for the tonal part and for the noise part. If the fade-out speed for the tonal part of the signal is slower, after multiple frame losses, the tonal part becomes dominant. The fluctuations in the sinusoid, which are due to the different phase shifts of the sinusoid components, produce unpleasant artifacts.

To overcome this problem, in accordance with embodiments, starting from the third lost frame, the phase difference of the peak (with index k) is used for all spectral coefficients surrounding it (k−l is the index of the left foot and k+u is the index of the right foot):

$$\Delta\varphi_{m+2}(i)=\Delta\varphi(k), i\in[k-l,k+u].$$

In accordance with further embodiments, a transition is provided. The spectral coefficients in the second lost frame with a high attenuation use the phase difference of the peak, and coefficients with small attenuation use the corrected phase difference:

$$\Delta\varphi_{m+1}(i)=\begin{cases}\Delta\varphi(k), & Q_{m-2}(i)\le Thresh_2(i)\cdot Q_{m-2}(k)\\ \Delta\varphi(i), & Q_{m-2}(i)>Thresh_2(i)\cdot Q_{m-2}(k)\end{cases}$$

$$Thresh_2(i)=10^{\frac{|i-k+\Delta l|\cdot 5\ dB}{20}}$$

$$i\in[k-l,k+u].$$

Magnitude Refinement

In accordance with other embodiments, instead of applying the above described phase shift refinement, another approach may be applied which uses a magnitude refinement:

$$Q_{m-1}(k) = \frac{C_{m-1}(k)}{\cos(\varphi_{m-2}(k) + \Delta\varphi(k))}$$

$$C_m(k) = Q_{m-1}(k) \cdot \cos(\varphi_{m-2}(k) + 2\Delta\varphi(k))$$

where l is the index of a peak, the fractional frequency Δl is calculated as described above. The phase shift is:

$$\Delta\varphi = \pi \cdot (l + \Delta l).$$

To avoid an increase in energy, the refined magnitude, in accordance with further embodiments, may be limited by the magnitude from the second last frame:

$$Q_{m-1}(k) = \max(Q_{m-1}(k), Q_{m-2}(k)).$$

Further, in accordance with yet further embodiments, the decrease in magnitude may be used for fading it:

$$Q_{m-1+i}(k) = Q_{m-1}(k) \cdot \left(\frac{Q_{m-1}(k)}{Q_{m-2}(k)}\right)^i.$$

Phase Prediction Using the "Frame In-Between"

Figure 6:
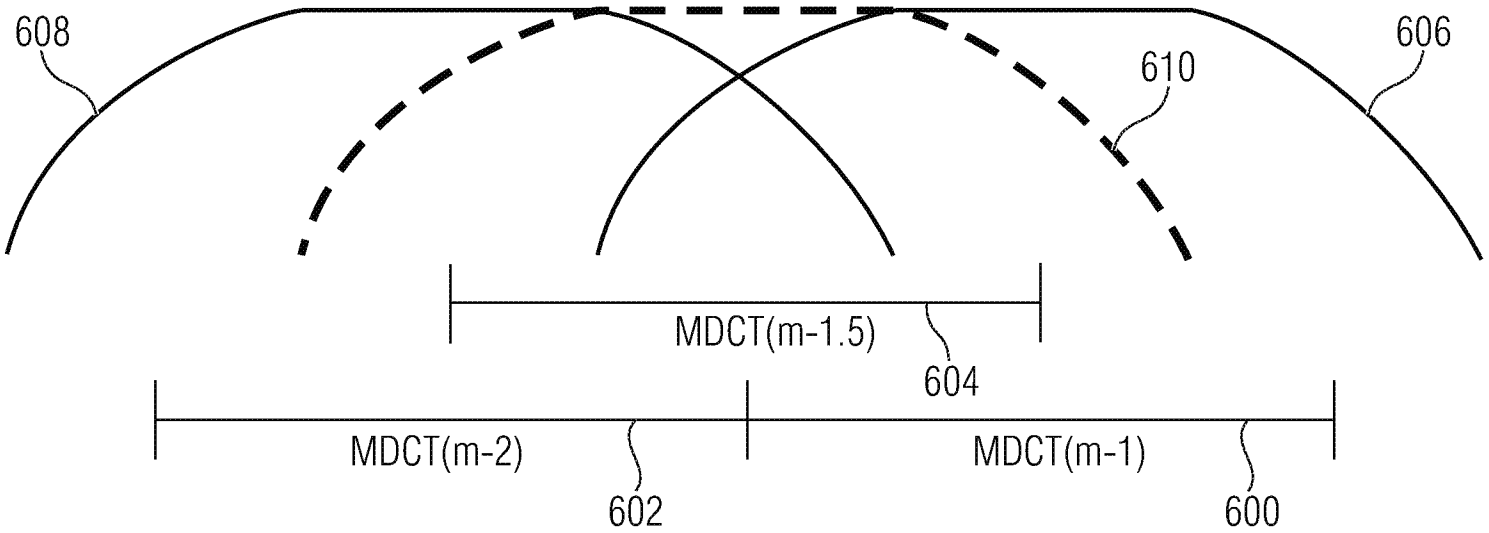
FIG. 6 shows an example for a "frame in-between"
Figure 7:
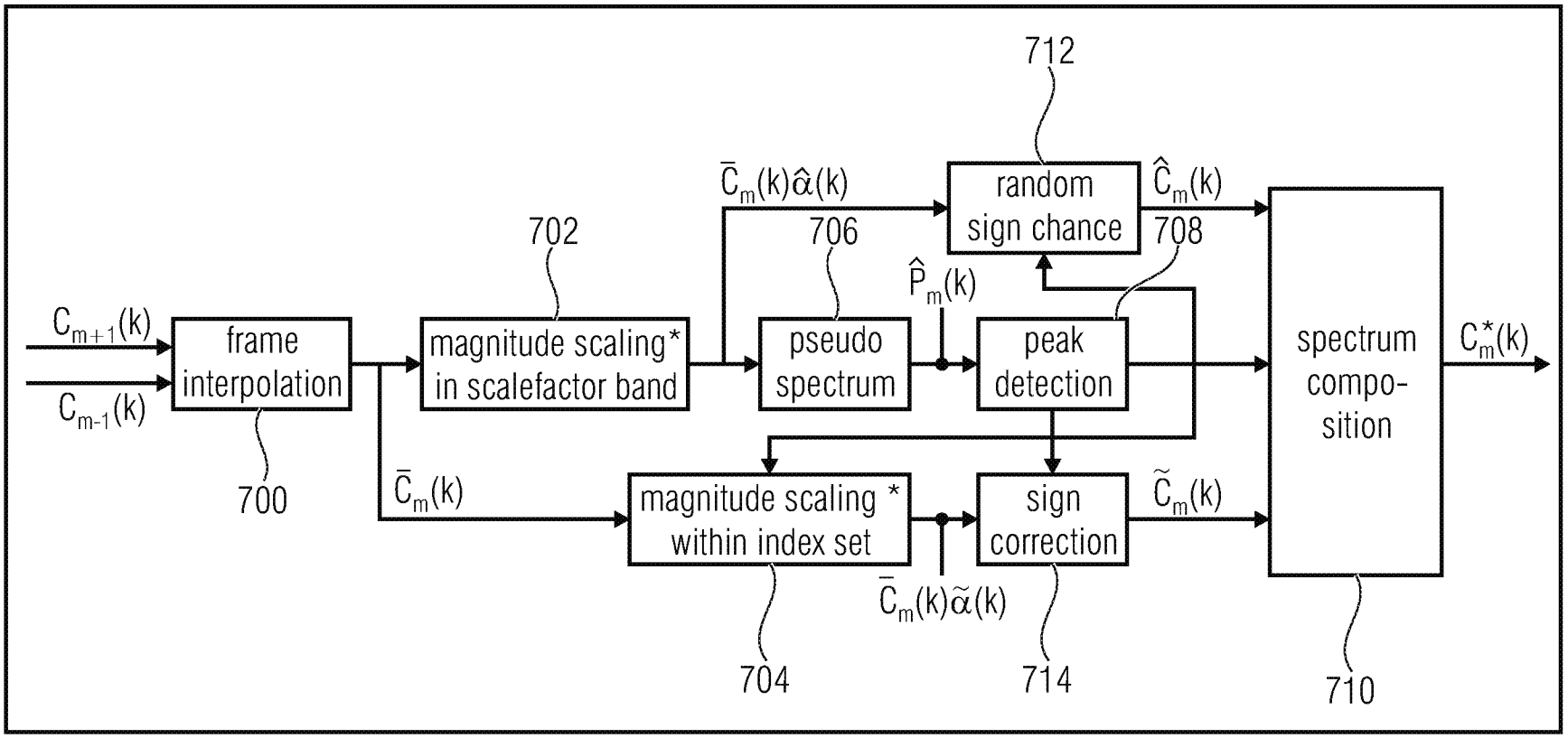
FIG 7 (PRIOR ART)
FIG. 7 shows a block diagram representing an interpolation approach without transmitted side information.
Figure 8:
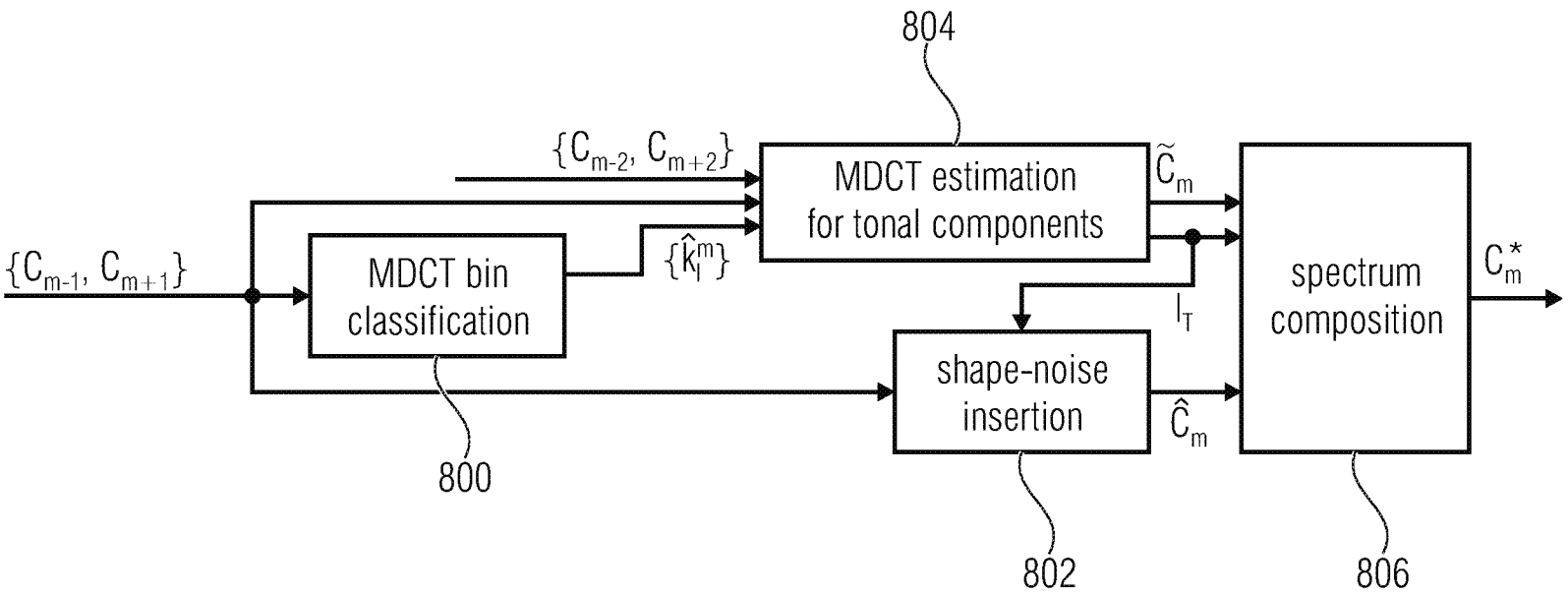
FIG 8 (PRIOR ART)
FIG. 8 shows a block diagram of an overall FLC technique refined when compared to FIG. 7.

Instead of basing the prediction of the spectral coefficients on the frames preceding the replacement frame, in accordance with other embodiments, the phase prediction may use a "frame in-between" (also referred to as "intermediate" frame). FIG. 6 shows an example for a "frame in-between". In FIG. 6 the last frame 600 (m−1) preceding the replacement frame, the second last frame 602 (m−2) preceding the replacement frame, and the frame in-between 604 (m−1,5) are shown together with the associated MDCT windows 606 to 610.

If the MDCT window overlap is less than 50% it is possible to get the CMDCT spectrum closer to the lost frame. In FIG. 6 an example with a MDCT window overlap of 25% is depicted. This allows to obtain the CMDCT spectrum for the frame in-between 604 (m−1,5) using the dashed window 610, which is equal to the MDCT window 606 or 608 but with the shift for half of the frame length from the codec framing. Since the frame in-between 604 (m−1,5) is closer in time to the lost frame (m), its spectrum characteristics will be more similar to the spectrum characteristics of the lost frame (m) than the spectral characteristics between the second last frame 602 (m−2) and the lost frame (m).

In this embodiment, the calculation of both the MDST coefficients $S_{m-1.5}$ and the MDCT coefficients $C_{m-1.5}$ is done directly from the decoded time domain signal, with the MDST and MDCT constituting the CMDCT. Alternatively the CMDCT can be derived using matrix operations from the neighboring existing MDCT coefficients.

The power spectrum calculation is done as described above, and the detection of tonal components is done as described above with the m−2nd frame being replaced by the m−1.5th frame.

For a sinusoidal signal $$x(t) = A \cdot \sin\left(\frac{2\pi}{N}(l + \Delta l)n + \phi\right)$$

a shift for N/4 (MDCT hop size) results in the signal $$x(t) = A \cdot \sin\left(\frac{2\pi}{N}(l + \Delta l)\left(n + \frac{N}{4}\right) + \phi\right) = A \cdot \sin\left(\frac{2\pi}{N}(l + \Delta l)n + \frac{\pi}{2}(l + \Delta l) + \phi\right)$$

This results in the phase shift $$\Delta\varphi_{0.5} = \frac{\pi}{2} \cdot (l + \Delta l).$$

Hence the phase shift depends on the fractional part of the input frequency plus additional adding of $$(l \bmod 4)\frac{\pi}{2},$$

where l is the index of a peak. The detection of the fractional frequency is done as described above.

For the prediction of the MDCT coefficients in a lost frame, the magnitude from the m−1.5 frame is used:

$$Q_{m-1.5}(k) = \sqrt{P_{m-1.5}(k)} = \sqrt{|S_{m-1.5}(k)|^2 + |C_{m-1.5}(k)|^2}.$$

The lost MDCT coefficient is estimated as:

$$C_m(k) = Q_{m-1.5}(k) \cdot \cos(\varphi_m(k)).$$

The phase $\varphi_m(k)$ can be calculated using:

$$\varphi_{m-1.5}(k) = \arctan\left(\frac{S_{m-1.5}(k)}{C_{m-1.5}(k)}\right)$$

$$\varphi_m(k) = \varphi_{m-1.5}(k) + 3\Delta\varphi_{0.5}(k)$$

Further, in accordance with embodiments, the phase shift refinement described above may be applied:

$$S_{m-1}(k) = Q_{m-1.5}(k) \cdot \sin(\varphi_{m-1.5}(k) + \Delta\varphi_{0.5}(k))$$

$$\varphi_{m-1}(k) = \arctan\left(\frac{S_{m-1}(k)}{C_{m-1}(k)}\right)$$

$$\Delta\varphi_{0.5}(k) = \varphi_{m-1}(k) - \varphi_{m-1.5}(k)$$

$$\varphi_m(k) = \varphi_{m-1}(k) + 2\Delta\varphi_{0.5}(k).$$

Further the convergence of the phase shift for all spectral coefficients surrounding a peak to the phase shift of the peak can be used as described above.

Although some aspects of the described concept have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A method for obtaining spectrum coefficients for a replacement frame m of an audio signal, the method comprising:

detecting a tonal component of a spectrum of an audio signal, wherein a peak that exceeds a predefined threshold and exists in spectra of a last frame m−1 and a second to last frame m−2 preceding the replacement frame m represents a tonal component;

for the tonal component of the spectrum, predicting spectrum coefficients for the peak and for a surrounding of the peak in the spectrum of the replacement frame m, wherein the surrounding of the peak is represented by spectral coefficients neighboring the peak; and for a non-tonal component of the spectrum, using a non-predicted spectrum coefficient for the replacement frame m or a corresponding spectrum coefficient of a frame preceding the replacement frame m.

2. The method of claim 1, wherein the spectrum coefficients for the peak and surrounding of the peak in the spectrum of the replacement frame m is predicted based on a magnitude of the complex spectrum of a frame preceding the replacement frame m and a predicted phase of the complex spectrum of the replacement frame, and the phase of the complex spectrum of the replacement frame m is predicted based on the phase of the complex spectrum of a frame preceding the replacement frame m and a phase shift between the frames preceding the replacement frame m.

3. The method of claim 2, wherein the spectrum coefficients for the peak and surrounding of the peak in the spectrum of the replacement frame m is predicted based on the magnitude of the complex spectrum of the second to last frame m−2 preceding the replacement frame m and the predicted phase of the complex spectrum of the replacement frame m, and the phase of the complex spectrum of the replacement frame m is predicted based on the complex spectrum of the second to last frame m−2 preceding the replacement frame m.

4. The method of claim 2, wherein the phase of the complex spectrum of the replacement frame m is predicted based on a phase for each spectrum coefficient at the peak and the surrounding of the peak in the frame preceding the replacement frame m.

5. The method of claim 2, wherein the phase shift between the frames preceding the replacement frame m is equal for each spectrum coefficient at the peak and the surrounding of the peak in the respective frames.

6. The method of claim 1, wherein the tonal component is defined by the peak and the surrounding of the peak.

7. The method of claim 1, wherein the surrounding of the peak is defined by a predefined number of coefficients around the peak.

8. The method of claim 1, wherein the surrounding of the peak comprises a first number of coefficients on the left from the peak and a second number of coefficients on the right from the peak.

9. The method of claim 8, wherein the first number of coefficients comprises coefficients between a left foot and the peak plus the coefficient of the left foot, and wherein the second number of coefficients comprises coefficients between a right foot and the peak plus the coefficient of the right foot.

10. The method of claim 8, wherein the first number of coefficients on the left from the peak and the second number of coefficients on the right from the peak are equal or different.

11. The method of claim 10, wherein the first number of coefficients on the left from the peak is three and the second number of coefficients on the right from the peak is three.

12. The method of claim 7, wherein the predefined number of coefficients around the peak is set prior to the step of detecting the tonal component.

13. The method of claim 1, wherein the size of the surrounding of the peak is adaptive.

14. The method of claim 13, wherein the surrounding of the peak is selected such that surroundings around two peaks do not overlap.

15. The method of claim 2, wherein the spectrum coefficient for the peak and the surrounding of the peak in the spectrum of the replacement frame m is predicted based on the magnitude of the complex spectrum of the second to last frame m−2 preceding the replacement frame m and the predicted phase of the complex spectrum of the replacement frame m, the phase of the complex spectrum of the replacement frame m is predicted based on the phase of the complex spectrum of the last frame m-1 preceding the replacement frame and a refined phase shift between the last frame and the second last frame preceding the replacement frame, the phase of the complex spectrum of the last frame m−1 preceding the replacement frame m is determined based on the magnitude of the complex spectrum of the second to last frame m−2 preceding the replacement frame m, the phase of the complex spectrum of the second to last frame m−2 preceding the replacement frame m, the phase shift between the last frame m−1 and the second to last frame preceding the replacement frame m and the real spectrum of the last frame m, and the refined phase shift is determined based on the phase of the complex spectrum of the last frame m−1 preceding the replacement frame m and the phase of the complex spectrum of the second to last frame m−2 preceding the replacement frame m.

16. The method of claim 15, wherein the refinement of the phase shift is adaptive based on the number of consecutively lost frames.

17. The method of claim 16, wherein starting from a third lost frame, a phase shift determined for a peak is used for predicting the spectral coefficients in the surrounding of the peak.

18. The method of claim 17, wherein for predicting the spectral coefficients in a second lost frame, a phase shift determined for the peak is used for predicting the spectral coefficients for the surrounding of the peak when the phase shift in the last frame m−1 preceding the replacement frame m is equal or below a predefined threshold, and a phase shift determined for the respective spectral coefficients for the surrounding of the peak is used for predicting the spectral coefficients of the surrounding of the peak when the phase shift in the last frame m−1 preceding the replacement frame m is above the predefined threshold.

19. The method of claim 2, wherein the spectrum coefficient for the peak and surrounding of the peak in the spectrum of the replacement frame m is predicted based on a refined magnitude of the complex spectrum of the last frame m−1 preceding the replacement frame m and the predicted phase of the complex spectrum of the replacement frame m, and the phase of the complex spectrum of the replacement frame m is predicted based on the phase of the complex spectrum of the second to last frame m−2 preceding the replacement frame m and twice the phase shift between the last frame m−1 and the second to last frame m−2 preceding the replacement frame m.

20. The method of claim 19, wherein the refined magnitude of the complex spectrum of the last frame m−1 preceding the replacement frame m is determined based on a real spectrum coefficient of the real spectrum of the last frame m−1 preceding the replacement frame m, the phase of the complex spectrum of the second to last frame m−2 preceding the replacement frame m and the phase shift between the last frame m−1 and the second to last frame m−2 preceding the replacement frame m.

21. The method of claim 19 or 20, wherein the refined magnitude of the complex spectrum of the last frame m−1 preceding the replacement frame m is limited by the magnitude of the complex spectrum of the second to last frame m−2 preceding the replacement frame m.

22. The method of claim 2, wherein the spectrum coefficient for the peak and the surrounding of the peak in the spectrum of the replacement frame m is predicted based on the magnitude of the complex spectrum of an intermediate frame between the last frame m−1 and the second to last frame m−2 preceding the replacement frame m and the predicted phase of the complex spectrum of the replacement frame m.

23. The method of claim 22, wherein the phase of the complex spectrum of the replacement frame m is predicted based on the phase of the complex spectrum of the intermediate frame preceding the replacement frame m and a phase shift between intermediate frames preceding the replacement frame m, or the phase of the complex spectrum of the replacement frame m is predicted based on the phase of the complex spectrum of the last frame m−1 preceding the replacement frame m and a refined phase shift between intermediate frames preceding the replacement frame m, the refined phase shift being determined based on the phase of the complex spectrum of the last frame m−1 preceding the replacement frame m and the phase of the complex spectrum of the intermediate frame preceding the replacement frame m.

24. The method of claim 1, wherein detecting a tonal component of the spectrum of the audio signal comprises:

searching peaks in the spectrum of the last frame m−1 preceding the replacement frame m based on one or more predefined thresholds;

adapting the one or more thresholds; and searching peaks in the spectrum of the second to last frame m−2 preceding the replacement frame m based on one or more adapted thresholds.

25. The method of claim 24, wherein adapting the one or more thresholds comprises setting the one or more thresholds for searching a peak in the second to last frame m−2 preceding the replacement frame m in a region around a peak found in the last frame m−1 preceding the replacement frame m based on the spectrum and a spectrum envelope of the last frame m−1 preceding the replacement frame m, or based on a fundamental frequency.

26. The method of claim 25, wherein the fundamental frequency is for the signal including the last frame m−1 preceding the replacement frame m and the look-ahead of the last frame m−1 preceding the replacement frame m.

27. The method of claim 26, wherein the look-ahead of the last frame m−1 preceding the replacement frame m is calculated on the encoder side using the look-ahead.

28. The method of claim 24, wherein adapting the one or more thresholds comprises setting the one or more thresholds for searching a peak in the second to last frame m−2 preceding the replacement frame m in a region not around a peak found in the last frame m−1 preceding the replacement frame m to a predefined threshold value.

29. The method of claim 1, comprising:

determining for the replacement frame m whether to apply a time domain concealment or a frequency domain concealment using the prediction of spectrum coefficients for tonal components of the audio signal.

30. The method of claim 29, wherein the frequency domain concealment is applied in case the last frame m−1 preceding the replacement frame m and the second to last frame m−2 preceding the replacement frame m have a constant pitch, or an analysis of one or more frames preceding the replacement frame m indicates that a number of tonal components in the signal exceeds a predefined threshold.

31. The method of claim 1, wherein the frames of the audio signal are coded using MDCT.

32. The method of claim 1, wherein a replacement frame comprises a frame m that cannot be processed at an audio signal receiver, e.g. due to an error in the received data, or a frame that was lost during transmission to the audio signal receiver, or a frame not received in time at the audio signal receiver.

33. The method of claim 1, wherein a non-predicted spectrum coefficient is generated using a noise generating method, the noise generating method including sign scrambling, or using a predefined spectrum coefficient from a memory, the memory including a look-up table.

34. A non-transitory computer program product comprising a computer readable medium storing instructions which, when executed on a computer, carry out a method comprising:

detecting a tonal component of a spectrum of an audio signal, wherein a peak that exceeds a predefined threshold and exists in spectra of a last frame m−1 and a second to last frame m−2 preceding a replacement frame m represents a tonal component;

for the tonal component of the spectrum, predicting spectrum coefficients for the peak and for a surrounding of the peak in the spectrum of the replacement frame m, wherein the surrounding of the peak is represented by spectral coefficients neighboring the peak; and for the non-tonal component of the spectrum, using a non-predicted spectrum coefficient for the replacement frame m or a corresponding spectrum coefficient of a frame preceding the replacement frame m.

35. An apparatus for obtaining spectrum coefficients for a replacement frame m of an audio signal, the apparatus comprising:

a detector configured to detect a tonal component of a spectrum of an audio signal, wherein on a peak that exceeds a predefined threshold and exists in spectra of a last frame m−1 and a second to last frame m−2 preceding a replacement frame m represents a tonal component; and a predictor configured to predict for the tonal component of the spectrum the spectrum coefficients for the peak and for a surrounding of the peak in the spectrum of the replacement frame m, wherein the surrounding of the peak is represented by spectral coefficients neighboring the peak;

wherein for the non-tonal component of the spectrum a non-predicted spectrum coefficient for the replacement frame m or a corresponding spectrum coefficient of a frame preceding the replacement frame m is used.

36. An apparatus for obtaining spectrum coefficients for a replacement frame m of an audio signal, the apparatus being configured to operate according to a method comprising:

detecting a tonal component of a spectrum of an audio signal, wherein a peak that exceeds a predefined threshold and exists in spectra of a last frame m−1 and a second to last frame m−2 preceding a replacement frame m represents a tonal component;

for the tonal component of the spectrum, predicting spectrum coefficients for the peak and for a surrounding of the peak in the spectrum of the replacement frame m, wherein the surrounding of the peak is represented by spectral coefficients neighboring the peak; and for the non-tonal component of the spectrum, using a non-predicted spectrum coefficient for the replacement frame m or a corresponding spectrum coefficient of a frame preceding the replacement frame m.

37. An audio decoder, comprising an apparatus for obtaining spectrum coefficients for a replacement frame m of an audio signal, the apparatus comprising:

a detector configured to detect a tonal component of a spectrum of an audio signal, wherein a peak that exceeds a predefined threshold and exists in spectra of a last frame m−1 and a second to last frame m−2 preceding a replacement frame m represents a tonal component; and a predictor configured to predict for the tonal component of the spectrum the spectrum coefficients for the peak and for a surrounding of the peak in the spectrum of the replacement frame m, wherein the surrounding of the peak is represented by spectral coefficients neighboring the peak;

wherein for the non-tonal component of the spectrum a non-predicted spectrum coefficient for the replacement frame m or a corresponding spectrum coefficient of a frame preceding the replacement frame m is used.

38. An audio receiver, comprising an audio decoder including an apparatus for obtaining spectrum coefficients for a replacement frame m of an audio signal, wherein the apparatus for obtaining spectrum coefficients for a replacement frame m of an audio signal comprises a detector configured to detect a tonal component of a spectrum of an audio signal, wherein a peak that exceeds a predefined threshold and exists in spectra of a last frame m−1 and a second to last frame m−2 preceding a replacement frame m represents a tonal component; and a predictor configured to predict for the tonal component of the spectrum the spectrum coefficients for the peak and for a surrounding of the peak in the spectrum of the replacement frame m, wherein the surrounding of the peak is represented by spectral coefficients neighboring the peak;

wherein for the non-tonal component of the spectrum a non-predicted spectrum coefficient for the replacement frame m or a corresponding spectrum coefficient of a frame preceding the replacement frame m is used.

39. A system for transmitting audio signals, the system comprising:

an encoder configured to generate coded audio signal; and a decoder configured to receive the coded audio signal, and to decode the coded audio signal, the decoder including an apparatus for obtaining spectrum coefficients for a replacement frame m of an audio signal, wherein the apparatus for obtaining spectrum coefficients for a replacement frame m of an audio signal comprises a detector configured to detect a tonal component of a spectrum of an audio signal, wherein a peak that exceeds a predefined threshold and exists in spectra of a last frame m−1 and a second to last frame m−2 preceding a replacement frame m represents a tonal component; and a predictor configured to predict for the tonal component of the spectrum the spectrum coefficients for the peak and for a surrounding of the peak in the spectrum of the replacement frame m, wherein the surrounding of the peak is represented by spectral coefficients neighboring the peak;

wherein for the non-tonal component of the spectrum a non-predicted spectrum coefficient for the replacement frame m or a corresponding spectrum coefficient of a frame preceding the replacement frame m is used.

* * * * *